US007524453B2

(12) United States Patent
Ugai et al.

(10) Patent No.: US 7,524,453 B2
(45) Date of Patent: Apr. 28, 2009

(54) APPARATUS FOR MANUFACTURING RING-SHAPED POWDER COMPACT AND METHOD OF MANUFACTURING SINTERED RING MAGNET

(75) Inventors: Yoshikazu Ugai, Tokyo (JP); Taizo Iwami, Tokyo (JP); Yuji Nakahara, Tokyo (JP)

(73) Assignee: Mitsubishi Denki Kabushiki Kaisha, Chiyoda-Ku, Tokyo (JP)

( * ) Notice: Subject to any disclaimer, the term of this patent is extended or adjusted under 35 U.S.C. 154(b) by 497 days.

(21) Appl. No.: 11/232,025

(22) Filed: Sep. 22, 2005

(65) Prior Publication Data

US 2006/0062683 A1 Mar. 23, 2006

(30) Foreign Application Priority Data

Sep. 22, 2004 (JP) ..... 2004-275176

(51) Int. Cl.
*B22F 3/087* (2006.01)

(52) U.S. Cl. ..... 419/38

(58) Field of Classification Search ..... 419/38; 355/302

See application file for complete search history.

(56) References Cited

U.S. PATENT DOCUMENTS

2006/0158292 A1* 7/2006 Ugai et al. ..... 335/302

FOREIGN PATENT DOCUMENTS

| | | |
|---|---|---|
| CN | 1176471 | 3/1998 |
| JP | 56-119699 | 9/1981 |
| JP | 57-146499 | 9/1982 |
| JP | 60-124812 | 7/1985 |
| JP | 05-271705 | 10/1993 |
| JP | 07-075321 | 3/1995 |
| JP | 7-263266 | 10/1995 |
| JP | 08-155698 | 6/1996 |
| JP | 9-35933 | 2/1997 |
| JP | 09-097731 | 4/1997 |
| JP | 11-234930 | 8/1999 |
| JP | 11-300497 | 11/1999 |
| JP | 2001-211581 | 8/2002 |
| JP | 2003-017309 | 1/2003 |
| JP | 2004-007960 | 1/2004 |
| WO | WO 2004/077647 | 9/2004 |

* cited by examiner

*Primary Examiner*—Scott Kastler
(74) *Attorney, Agent, or Firm*—Buchanan Ingersoll & Rooney PC

(57) ABSTRACT

An apparatus for manufacturing a ring-shaped powder compact (100) includes a ring-shaped die (80) having magnetic property formed by combining a plurality of arch-shaped members (81, 82, 83, 84), a lower core section (93) placed inside a curved inner surface of the die (80), and lower and upper punches (91, 92) for pressurizing both the die (80) and magnetic powder filled into a cavity formed between the die (80) and the lower core section (93) in an axial direction of the die (80). The curved inner surface of the die (80) varies in cross-sectional shape from one position to next along the axial direction of the die (80) at least in part along the axial direction. A ring magnet manufacturing method includes filling the magnetic powder into the cavity and producing the ring-shaped powder compact (100) by pressurizing the magnetic powder in the cavity in the axial direction by means of the lower and upper punches (91, 92) while applying a radially orienting magnetic field to the magnetic powder, and sintering the ring-shaped powder compact (100).

7 Claims, 18 Drawing Sheets

FORMING CAVITY

FILLING MAGNETIC POWDER

RADIAL ORIENTATION

PRESSING

DEPRESSURIZATION AND DIE RELEASING

RING-SHAPED POWDER COMPACT REMOVED
31
32
33
34
35
36
30
47

FORMING CAVITY

FILLING MAGNETIC POWDER

RADIAL ORIENTATION

PRESSING

RING-SHAPED POWDER COMPACT RELEASED

PRESSING FINISHED

SECTION J-J

SECTION L-L

SECTION K-K

APPARATUS FOR MANUFACTURING RING-SHAPED POWDER COMPACT AND METHOD OF MANUFACTURING SINTERED RING MAGNET

BACKGROUND OF THE INVENTION

1. Field of the Invention

The present invention relates to an apparatus and a method for manufacturing radially-oriented sintered ring magnets used in compact motors, for instance.

2. Description of the Background Art

A radially-oriented anisotropic ring magnet is often used in small-sized permanent magnet motors. The radially-oriented anisotropic ring magnet exhibits a generally rectangular magnetic field distribution pattern and, thus, one problem usually associated with a motor incorporating a radially-oriented anisotropic ring magnet is a high level of cogging torque.

A conventional approach commonly used for mitigating the cogging torque is to reduce distortion of the magnetic field distribution pattern of a ring magnet by skewed magnetization. This approach does not work so effectively, however, when it is necessary to suppress the cogging torque by a higher degree as in the case of a servomotor, for instance.

Another conventional approach to reducing the cogging torque is to form corrugations (hollows and protrusions) on a generally cylindrical outer surface of a ring magnet, the corrugations being skewed with respect to an axial direction of the ring magnet, as proposed in Japanese Patent Application Publication Nos. 1997-35933 and 2001-211581, for example. This approach makes it possible to reduce distortion of a magnetization distribution pattern in a rotating direction of the ring magnet by the corrugations as well as the cogging torque by virtue of the skewed corrugations.

Still another conventional approach to reducing the cogging torque caused by a radially-oriented anisotropic permanent ring magnet is shown in Japanese Patent Application Publication No. 1985-124812, the permanent ring magnet is manufactured by an injection molding method by using a metal die having hollows or protrusions formed at least in two areas on a curved inner surface or a curved outer surface or on both.

The ring magnets shown in the aforementioned Japanese Patent Application Publications are so-called bonded magnets which are produced by molding magnetic powder with thermosetting resin or thermoplastic resin used as a binder. Generally, magnetic force produced by the bonded magnets is so weak that the bonded magnets can not be used for manufacturing compact high-power motors. For example, a bonded rare-earth magnet produces a maximum energy product of about 10 to 25 MGOe which is low compared to an energy product of 40 MGOe produced by a typical sintered neodymium-ion-boron magnet. Since the magnetic force produced by the bonded magnets is so weak that the bonded magnets are not applicable to manufacturing servomotors which require a strong magnetic force.

The magnet shown in Publication No. 1997-35933 is a resin-molded magnet which must be formed by using a dedicated extruder. This extrusion molding process has a problem that the magnetic force of the resin-molded magnet which is weak by nature becomes still weaker because it is impossible to increase the magnetic force by applying a magnetic field during the molding process for anisotropically magnetizing the magnet.

Additionally, resin-molded magnets manufactured by the extruder are limited to shapes in which magnetic poles are obliquely formed, or skewed, with respect to an axial direction of the magnet. In a ring magnet used in a motor, however, magnetic properties of the magnet are not necessarily uniform along the axial direction, the ability of a magnetic circuit to conduct magnetic flux from the ring magnet to a stator, or permeance, varies along the axial direction, and saturation status of the stator varies along the axial direction. To cope with these problems, it is necessary to vary the shape of the magnet along the axial direction.

It would be possible to make a ring-shaped powder compact of which curved outer surface is corrugated with alternating hollows and protrusions which are skewed about a central axis of the ring-shaped powder compact by pressing magnetic powder by use of a conventional single-structured die. It is however impossible to draw out the ring-shaped powder compact from the conventional die. A compressive stress produced during a pressing process remains in the ring-shaped powder compact. Therefore, if one attempts to remove the ring-shaped powder compact from the die, a considerable friction force acts between the curved outer surface of the ring-shaped powder compact and a curved inner surface of the die, so that it would be necessary to pull the ring-shaped powder compact with a greater force than the friction force. In a case where skewed corrugations are formed on the curved inner surface of the die and on the curved outer surface of the ring-shaped powder compact, however, it is impossible to release the ring-shaped powder compact from the die by pulling the ring-shaped powder compact biased by the compressive stress while turning the same with a force greater than the friction force. The ring-shaped powder compact would break if forcibly drawn against the friction force due to the skewed corrugations.

SUMMARY OF THE INVENTION

The invention is intended to provide a solution to the aforementioned problems of the prior art. Accordingly, it is an object of the invention to provide an apparatus and a method for manufacturing a sintered ring magnet made of rare earth, for instance, capable of producing a powerful magnetic force, wherein the apparatus can vary the shape of the ring magnet along an axial direction thereof and reduce distortion of a magnetization distribution pattern in a rotating direction of the ring magnet as well as cogging torque of a motor when the ring magnet is used therein.

It is a more specific object of the invention to provide an apparatus and a method for manufacturing a sintered ring magnet having corrugations (protrusions and hollows) formed on a generally cylindrical outer surface thereof, the corrugations being skewed about a central axis of the ring magnet for reducing distortion of magnetization distribution along a rotating direction of the ring magnet as well as cogging torque of a motor when the ring magnet is used therein.

In one aspect of the invention, an apparatus for manufacturing a ring-shaped powder compact includes a ring-shaped die having elasticity, a core placed inside a curved inner surface of the die, and a pressurizing part for pressurizing both the die and magnetic powder filled into a cavity formed between the die and the core in an axial direction of the die. The curved inner surface of the die varies in cross-sectional shape from one position to next along the axial direction of the die as seen in planes perpendicular to a central axis of the die at least in part along the axial direction thereof.

In another aspect of the invention, a method of manufacturing a sintered ring magnet is performed by using an apparatus for manufacturing a ring-shaped powder compact, the apparatus including a ring-shaped die having elasticity and magnetic property, a core placed inside a curved inner surface of the die, and a pressurizing part for pressurizing both the die and magnetic powder filled into a cavity formed between the die and the core in an axial direction of the die, wherein the curved inner surface of the die varies in cross-sectional shape from one position to next along the axial direction of the die as seen in planes perpendicular to a central axis of the die at least in part along the axial direction thereof. The ring magnet manufacturing method includes the steps of filling the magnetic powder into the cavity, applying a radially orienting magnetic field to the magnetic powder, producing the ring-shaped powder compact by pressurizing the magnetic powder in the cavity in the axial direction by means of the pressurizing part, and sintering the ring-shaped powder compact.

According to the aforementioned apparatus and method for manufacturing a ring-shaped powder compact, a ring-shaped powder compact is produced by using the ring-shaped die having elasticity. Therefore, during a pressing process, the die deforms in such a manner that the curved inner surface of the die "expands" (or deviates) radially inward toward the central axis, causing the cavity in the die to reduce in volumetric capacity. When pressurizing force exerted by the pressurizing part is removed at the end of the pressing process, the die returns to its original shape, thereby creating a clearance between a curved outer surface of the ring-shaped powder compact and the curved inner surface of the die. Consequently, the ring-shaped powder compact can be easily released from the die without damaging. Furthermore, defects such as cracks would not easily occur in the ring-shaped powder compact in die release operation because an internal pressure (compressive stress) built up in the ring-shaped powder compact during the pressing process is uniformly released.

In still another aspect of the invention, an apparatus for manufacturing a ring-shaped powder compact includes a ring-shaped die formed by combining a plurality of arch-shaped members, a core placed inside a curved inner surface of the die, and pressurizing parts for pressurizing both the die and magnetic powder filled into a cavity formed between the die and the core in an axial direction of the die, The curved inner surface of the die varies in cross-sectional shape from one position to next along the axial direction of the die as seen in planes perpendicular to a central axis of the die at least in part along the axial direction thereof.

In yet another aspect of the invention, a method of manufacturing a sintered ring magnet is performed by using an apparatus for manufacturing a ring-shaped powder compact, the apparatus including a ring-shaped die having magnetic property formed by combining a plurality of arch-shaped members, a core placed inside a curved inner surface of the die, and pressurizing parts for pressurizing both the die and magnetic powder filled into a cavity formed between the die and the core in an axial direction of the die, wherein the curved inner surface of the die varies in cross-sectional shape from one position to next along the axial direction of the die as seen in planes perpendicular to a central axis of the die at least in part along the axial direction thereof. The ring magnet manufacturing method includes the steps of filling the magnetic powder into the cavity, applying a radially orienting magnetic field to the magnetic powder, producing the ring-shaped powder compact by pressurizing the magnetic powder in the cavity in the axial direction by means of the pressurizing parts, and sintering the ring-shaped powder compact.

In one preferred form of the invention, the curved inner surface of the die is corrugated with hollows and protrusions alternately formed at regular intervals in a circumferential direction.

In another preferred form of the invention, as viewed in cross section perpendicular to the central axis of the die, outermost portions of the hollows in the curved inner surface of the die form arc segments constituting part of a circle of which center lies on the central axis of the die.

In still another preferred form of the invention, the hollows and the protrusions formed on the curved inner surface of the die are skewed about the central axis of the die.

According to the aforementioned apparatus and method for manufacturing a ring-shaped powder compact, a ring-shaped powder compact is produced by using the ring-shaped die formed by combining a plurality of arch-shaped members. It is therefore possible to create a sufficient clearance between a corrugated curved outer surface of the ring-shaped powder compact and the corrugated curved inner surface of the die upon completion of a pressing process by moving the individual arch-shaped members radially outward by a distance larger than the difference in height between outermost points of the hollows and innermost points of the protrusions formed on the curved inner surface of the die, for instance. Consequently, the ring-shaped powder compact can be easily released from the die without damaging. Furthermore, defects such as cracks would not easily occur in the ring-shaped powder compact in die release operation because an internal pressure (compressive stress) built up in the ring-shaped powder compact during the pressing process is uniformly released.

It is possible to manufacture a sintered ring magnet by sintering and heat-treating a ring-shaped powder compact obtained by the aforementioned manufacturing apparatus and method of the invention. It is further possible to manufacture a sintered ring magnet having corrugations (alternating hollows and protrusions) formed on a curved outer surface of the sintered ring magnet, the corrugations being skewed about a central axis of the ring magnet, by subjecting a preliminary sintered ring magnet to a finishing (grinding) or specific surface treatment, where necessary.

Furthermore, it is possible to manufacture a motor with reduced cogging torque by using the sintered ring magnet having skewed corrugations on the curved outer surface as compared to a motor using a conventional ring magnet having an uncorrugated cylindrical outer surface. Moreover, the sintered ring magnet produced by the apparatus and method of the invention can be used for manufacturing a high-torque motor which can not be made by use of a conventional bonded magnet.

These and other objects, features and advantages of the invention will become more apparent upon reading the following detailed description along with the accompanying drawings.

DETAILED DESCRIPTION OF THE PREFERRED EMBODIMENTS OF THE INVENTION

Apparatuses and methods for manufacturing ring magnets according to preferred embodiments of the invention are described in the following.

First Embodiment

Figure 1:
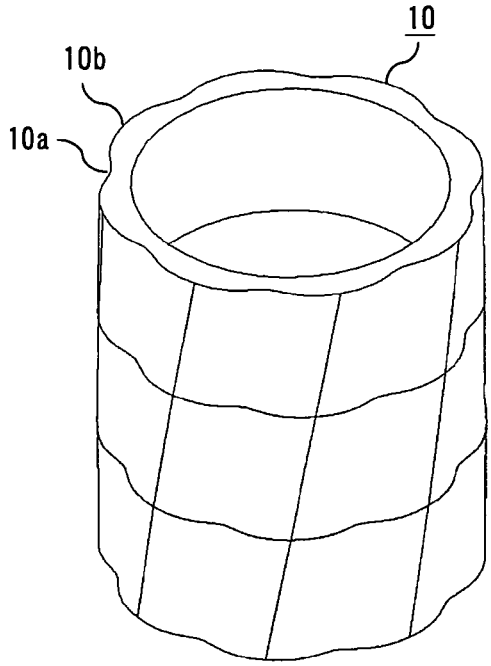
FIG. 1 is a perspective view of a sintered ring magnet produced by a manufacturing apparatus and method according to a first embodiment of the invention.

FIG. 1 is a perspective view of a sintered ring magnet 10 produced by a ring magnet manufacturing apparatus and method according to a first embodiment of the invention. The sintered ring magnet 10 has a generally cylindrical outer surface with surface corrugations formed thereon by alternating hollows 10*a* and protrusions 10*b* at regular intervals around the ring magnet 10. The hollows 10*a* and the protrusions 10*b* run in parallel lines which are skewed by a specific angle with respect to an axial direction of the ring magnet 10. The sintered ring magnet 10 has a maximum outside diameter of 34 mm as measured between outermost points of any two opposite protrusions 10*b*, a minimum outside diameter of 32 mm as measured between innermost points of any two opposite hollows 10*a*, an inside diameter of 28 mm, a maximum wall thickness of 3 mm and an axial length of 38 mm. In the example of FIG. 1, eight each hollows 10*a* and protrusions 10*b* are alternately formed at angular intervals of 45° obliquely around the outer surface of the sintered ring magnet 10 with a skew angle of 20°. Additionally, eight magnetic poles are formed at regular angular intervals around the sintered ring magnet 10. The magnetic poles are also skewed about a longitudinal axis (central axis) of the ring magnet 10 and run parallel to the surface corrugations with boundaries of the magnetic poles located in the hollows 10*a*. The sintered ring magnet 10 of FIG. 1 is a ring magnet produced by stacking three ring-shaped powder compacts 30 shown in FIG. 6 along the axial direction and joining these ring-shaped powder compacts 30 into a single structure by a sintering process.

Figure 2:
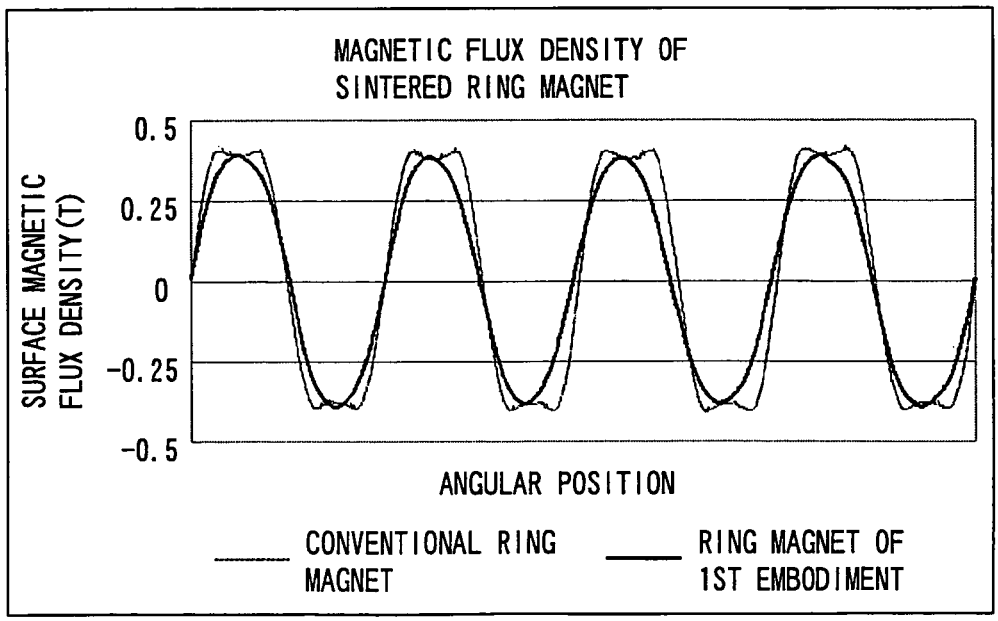
FIG. 2 is a diagram showing a surface magnetic flux density distribution of the sintered ring magnet of FIG. 1.

A shaft was fitted into and bonded to a cylindrical hole in the sintered ring magnet 10 of FIG. 1 and, then, the sintered ring magnet 10 was radially magnetized with a skew to form eight magnetic poles in such a manner that the eight magnetic poles would be located along ridges of the individual protrusions 10*b* formed on the generally cylindrical outer surface of the ring magnet 10. FIG. 2 is a diagram showing a magnetic flux density distribution of the ring magnet 10 measured around the generally cylindrical outer surface thereof by use of a Hall-effect device. FIG. 2 also shows a surface magnetic flux density distribution of a conventional cylindrical ring magnet for the sake of comparison. It is obvious from FIG. 2 that distortion of a magnetic field distribution pattern of the sintered ring magnet 10 of the present embodiment is significantly smaller than that of the conventional ring magnet.

The inventors have produced motors using the sintered ring magnet 10 of the embodiment and the conventional ring magnet and have ascertained that it is possible to reduce cogging torque of the motor to one-third by using the sintered ring magnet 10 of the embodiment.

A ring magnet pressing unit (metal die unit) and a pressing method used for manufacturing the sintered ring magnet 10 of FIG. 1 are now described.

Raw material used for manufacturing a sintered ring magnet of the invention is a magnetic alloy like $Nd_2Fe_{14}B$, for example. The prepared magnetic alloy is coarsely crushed and subjected to a hydrogen embrittlement treatment. Then, the magnetic alloy thus treated is pulverized into fine magnetic powder having an average particle size of about 5 micrometers by using a jet mill. A ring-shaped powder compact is formed by pressing the fine magnetic powder while magnetizing the same in a radial orientation pattern by a procedure discussed below.

Figure 4A:
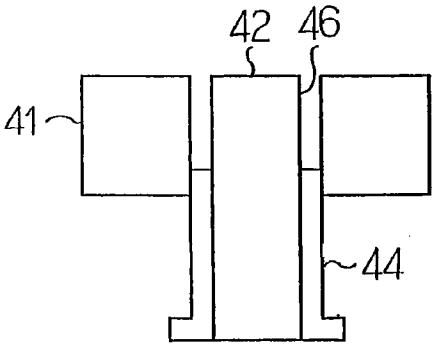
FIGS. 4A-4F are diagrams schematically showing a generally known pressing process for making a ring-shaped powder compact of a conventional radially-oriented ring magnet.
Figure 4B:
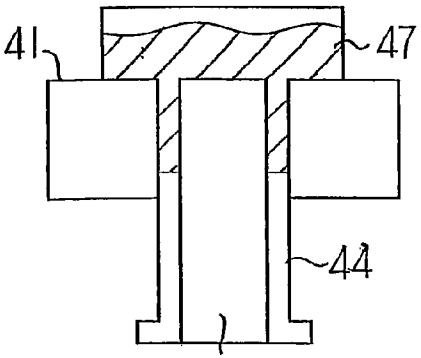
Figure 4C:
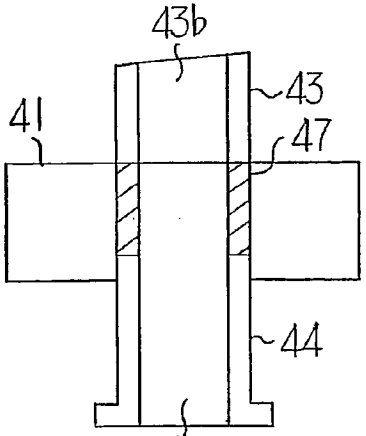
Figure 4D:
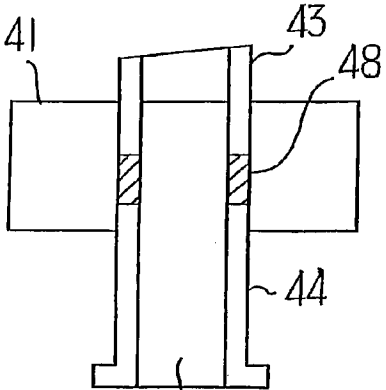
Figure 4E:
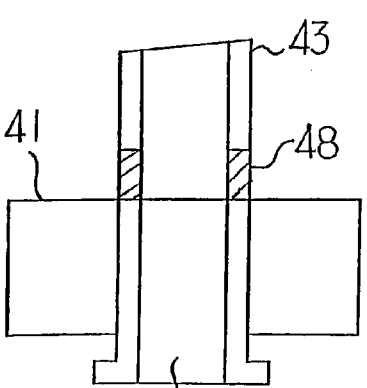
Figure 4F:
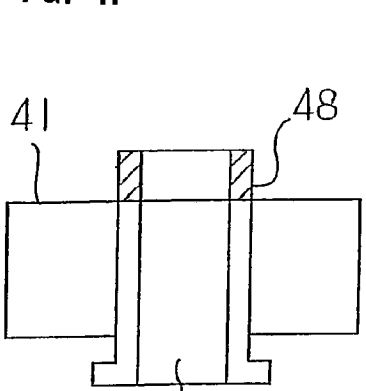
Figure 5:
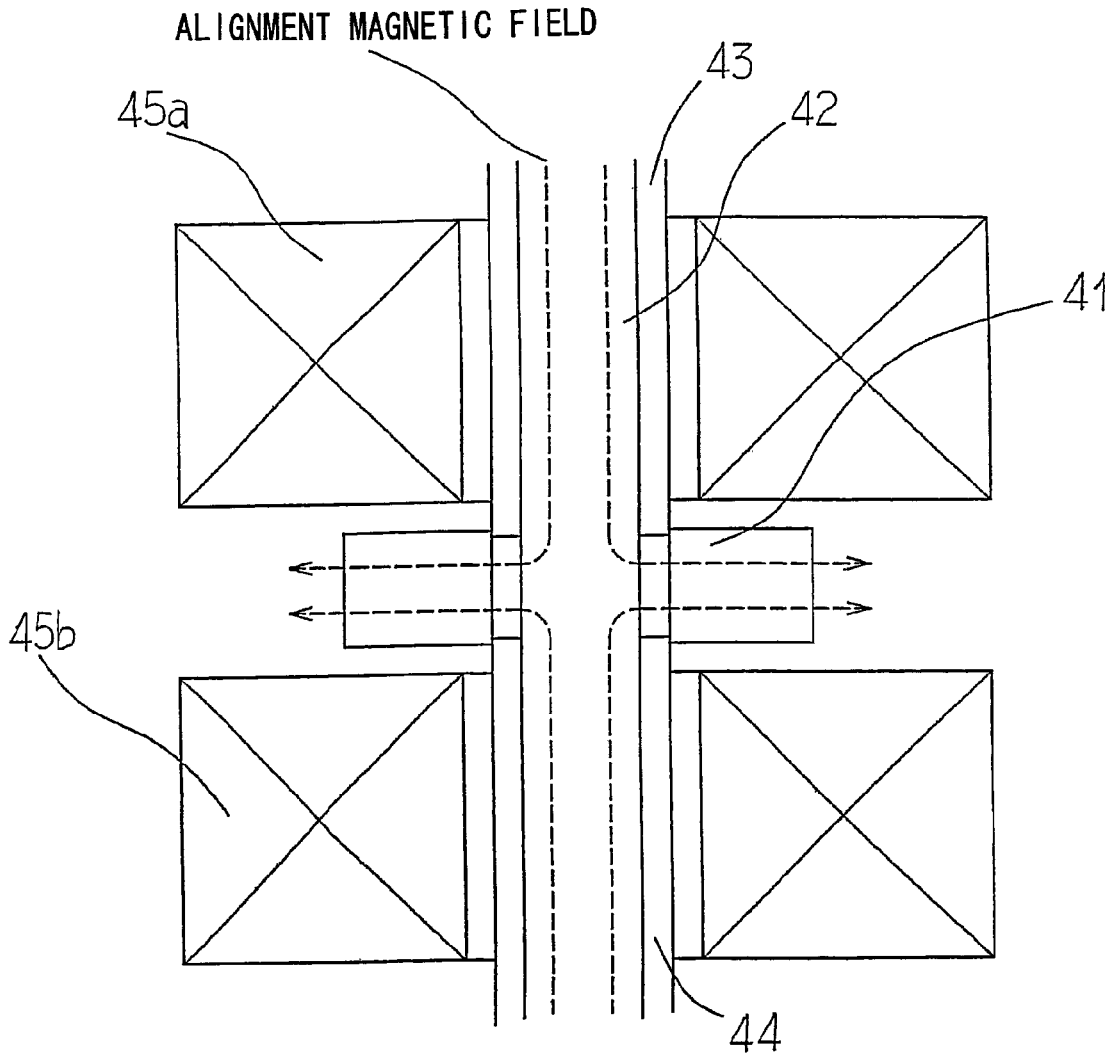
FIG. 5 is a diagram schematically showing a radially orienting magnetic field.

FIGS. 4A-4F are diagrams schematically showing a generally known pressing process for making a ring-shaped powder compact of a conventional radially-oriented ring magnet, and FIG. 5 is a diagram schematically showing a radially orienting magnetic field.

As illustrated in FIGS. 4A-4F, a metal die unit used in a conventional ring magnet manufacturing apparatus for producing the ring-shaped powder compact of the radially-oriented ring magnet includes a die 41 made of ferromagnetic material, a core 42 placed inside a curved inner surface of the die 41, and upper and lower punches 43, 44 made of nonmagnetic material. Referring to FIG. 5, the metal die unit includes a pair of upper and lower coils 45*a*, 45*b* for generating the radially orienting magnetic field. The upper coil 45*a* generates a magnetic field of which lines of magnetic flux are downward directed while the lower coil 45*b* generates a magnetic field of which lines of magnetic flux are upward directed. Both the upward- and downward-directed magnetic fluxes pass through the core 42 and are guided into a cavity 46. The magnetic fluxes pass through the cavity 46 and the die 41 in radial directions and return to the upper and lower coils 45*a*, 45*b*, recirculating through upper and lower looping paths. Under conditions where the radially orienting magnetic field passes through the cavity 46, magnetic powder 47 filled in the cavity 46 is compressed by the upper punch 43 or the lower punch 44 in an axial direction of the die 41, whereby a ring-shaped powder compact 48 is obtained.

Now, the conventional pressing process is explained with reference to FIGS. 4A-4F.

(1) The cavity 46 is formed by the die 41, the core 42 and the lower punch 44 as shown in FIG. 4A.

(2) The magnetic powder 47 is filled into the cavity 46 by an unillustrated powder feeder as shown in FIG. 4B.

(3) The upper punch 43 and an upper core section 43*b* descend and, with the cavity 46 closed, the radially orienting magnetic field is applied to the magnetic powder 47 as shown in FIG. 4C. At this time, the upper core section 43*b* and the core 42 are in contact with each other, together forming a magnetic path.

(4) As the upper punch 43 descends, the magnetic powder 47 in the cavity 46 is compressed in the axial direction of the die 41 as shown in FIG. 4D, whereby the ring-shaped powder compact 48 is formed.

(5) After pressurizing force exerted by the upper punch 43 is removed, the die 41 is lowered to release the ring-shaped powder compact 48 from the die 41 as shown in FIG. 4E.

(6) After the upper punch 43 has ascended as shown in FIG. 4F, the ring-shaped powder compact 48 is removed from the metal die unit.

Figure 6:
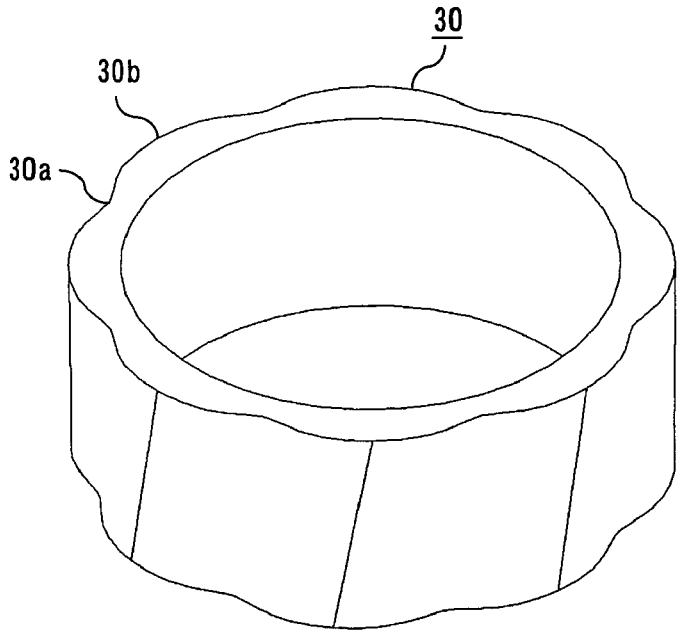
FIG. 6 is a perspective view showing an example of a ring-shaped powder compact produced by the first embodiment of manufacturing a sintered ring magnet.

Although ring-shaped powder compacts having an unchanging cross-sectional shape along an axial direction thereof can be pressed by the above-described conventional pressing process, the conventional pressing process and metal die unit can not be used to make ring-shaped powder compacts for manufacturing the aforementioned ring magnets of the present embodiment of which cross-sectional shape varies along the axial direction due to longitudinally skewed surface corrugations as shown in FIG. 6, for example.

Reasons why the conventional pressing process and metal die unit can not be used for manufacturing the ring magnets of the invention are as follows. Referring again to FIGS. 4A-4F, the ring-shaped powder compact 48 is pressurized by the upper punch 43 during the pressing process so that the ring-shaped powder compact 48 is biased to radially expand due to a compressive stress remaining therein while the ring-shaped powder compact 48 is held in the die 41 even after the pressurizing force exerted by the upper punch 43 has been removed. Therefore, if one attempts to remove the ring-shaped powder compact 48 in the axial direction, a friction force acts between the ring-shaped powder compact 48 and the curved inner surface of the die 41. If the cross-sectional shape of the ring-shaped powder compact 48 remains the same along the axial direction, it would be possible to release the ring-shaped powder compact 48 from the die 41 by simply pushing the ring-shaped powder compact 48 in the axial direction. (In the example shown in FIGS. 4A-4F, the lower punch 44 is kept at a fixed position and the die 41 is pulled downward when releasing the ring-shaped powder compact 48.) If the cross-sectional shape of the ring-shaped powder compact varies along the axial direction, however, it is not possible to release the ring-shaped powder compact from the die 41 by simply pushing the ring-shaped powder compact in the axial direction.

FIG. 6 shows the ring-shaped powder compact 30 produced by the ring magnet manufacturing method of the first embodiment. The ring-shaped powder compact 30 has corrugations (hollows 30*a* and protrusions 30*b*) formed on a generally cylindrical outer surface, the corrugations being skewed about an axial direction of the ring-shaped powder compact 30. Since the skew angle of the corrugations is uniform along the axial direction of the ring-shaped powder compact 30 in this example, it is possible to remove the ring-shaped powder compact 30 from a die by drawing the ring-shaped powder compact 30 while rotating it at a fixed rate from a geometrical point of view. In actuality, however, the ring-shaped powder compact 30 is not strong enough to withstand a friction force exerted by a curved inner surface of the die, so that the ring-shaped powder compact 30 would inevitably break if forcibly drawn against the friction force by such die release operation.

Figure 7:
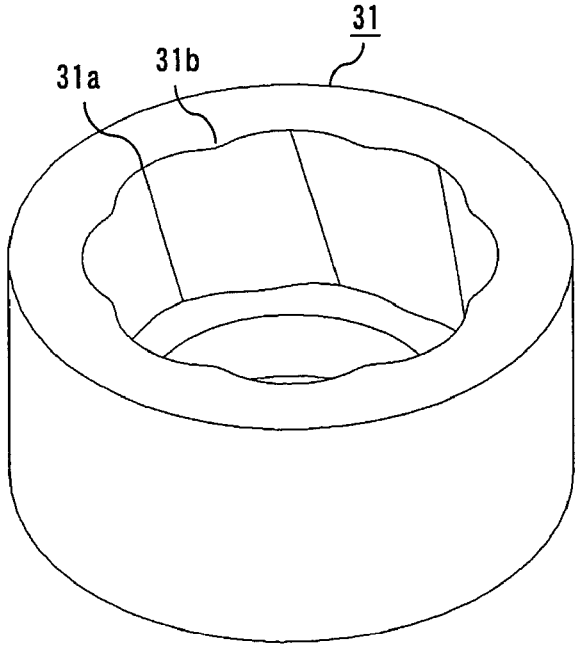
FIG. 7 is a perspective view of a die used in a ring magnet pressing unit of the manufacturing apparatus of the first embodiment.

FIG. 7 is a perspective view of a ring-shaped die 31 used in the ring magnet pressing unit (metal die unit) of the ring magnet manufacturing apparatus of the first embodiment, and FIGS. 3A-3F are diagrams schematically showing a pressing process according to the first embodiment performed by using the die 31 of FIG. 7.

As illustrated in FIGS. 3A-3F, the metal die unit of the ring magnet manufacturing apparatus of the first embodiment for producing a ring-shaped powder compact includes the ring-shaped die 31 made of elastic material, a core 32 made of ferromagnetic material placed inside a curved inner surface of the die 31, a ring-shaped member 33 made of ferromagnetic material placed outside a curved outer surface of the die 31, and a base 34 for mounting the die 31, the core 32 and the ring-shaped member 33. Magnetic powder 47 is filled into a cavity 35 surrounded by the curved inner surface of the die 31 and a curved outer surface of the core 32.

Referring to FIG. 7, the curved inner surface of the die 31 is corrugated with eight each hollows 31*a* and protrusions 31*b* alternately formed at regular angular intervals (45°) in a circumferential direction. These corrugations are twisted by a skew angle of 6.87° about an axial direction of the die 31. A generally cylindrical internal space of the die 31 has an axial length of 16.2 mm, a maximum inside diameter of 44 mm as measured between outermost points of any two opposite hollows 31*a* and a minimum inside diameter of 42 mm as measured between innermost points of any two opposite protrusions 31*b*, and the core 32 has an outside diameter of 33 mm. The difference in height between the outermost points of the hollows 31*a* and the innermost points of the protrusions 31*b* is 1 mm.

Figures 3A, 3B, 3C, 3D, 3E, 3F:
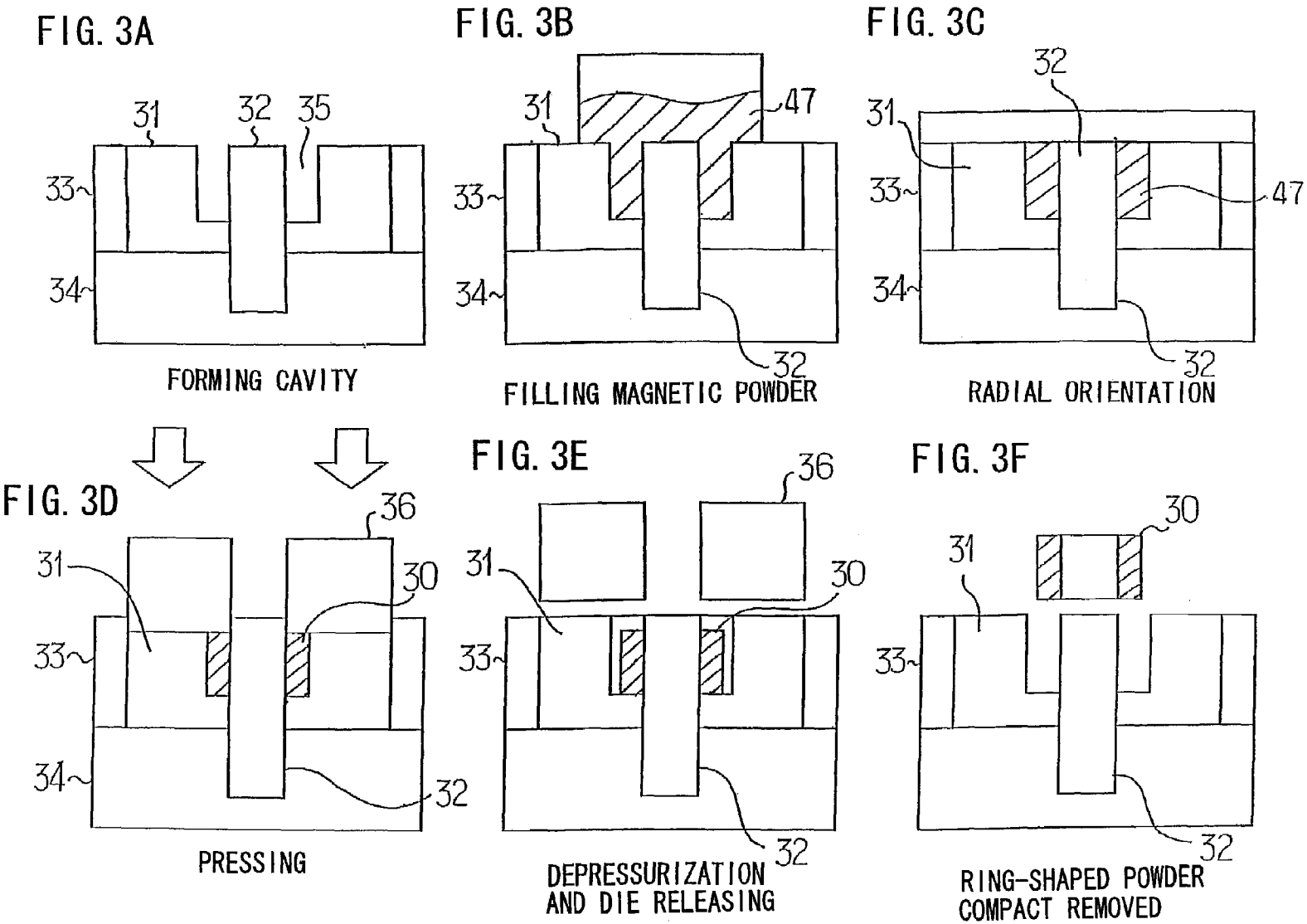
FIGS. 3A-3F are diagrams schematically showing a pressing process for making a ring-shaped powder compact according to the first embodiment of the invention.

A punch 36 shown in FIG. 3D serves as a pressurizing part for pressurizing both the die 31 and the magnetic powder 47 filled into the cavity 35. The die 31 is made of silicone rubber in gel form and contains 40% to 70% by volume of iron powder, for instance, so that the die 31 can be used when applying a radially orienting magnetic field. The iron powder is uniformly dispersed within the volume of die 31.

Now, the pressing process for making the ring-shaped powder compact 30 according to the first embodiment of the invention is explained with reference to FIGS. 3A-3F.

(1) The cavity 35 is formed by the die 31 and the core 32 as shown in FIG. 3A.

(2) The magnetic powder 47 is filled into the cavity 35 as shown in FIG. 3B so that a bulk density of 20.5 is attained.

(3) A radially orienting magnetic field is applied to the magnetic powder 47 in the cavity 35 as shown in FIG. 3C at a magnetic flux density of 3 tesla or more.

(4) The punch 36 made of nonmagnetic material pressurizes the magnetic powder 47 in the cavity 35 and the die 31 together in the axial direction as shown in FIG. 3D. Since the die 31 having elasticity is constrained on the curved outer surface by the ring-shaped member 33, the die 31 deforms as if expanding inward toward a central axis thereof. Thus, the magnetic powder 47 in the cavity 35 is pressed by pressurization axially downward by the punch 36 and radially inward by the die 31. Consequently, the magnetic powder 47 is formed into the ring-shaped powder compact 30 having a maximum outside diameter of 42.24 mm, an inside diameter of 33 mm and a height of 15.55 mm.

(5) Next, the punch 36 is lifted upward as shown in FIG. 3E. As a result, the die 31 which has been deformed inward toward the central axis due to radial pressurization returns to an original shape and a clearance is created between the curved outer surface of the ring-shaped powder compact 30 and the curved inner surface of the die 31. Since the maximum outside diameter of the ring-shaped powder compact 30 is 42.24 mm (as measured between any two opposite protrusions 30*a*) and the minimum inside diameter of the die 31 when not pressurized is 42 mm (as measured between innermost points of any two opposite protrusions 31*b*) as already mentioned, there is created a clearance of at least about 0.1 mm between the ring-shaped powder compact 30 and the die 31.

(6) The pressing process is completed by releasing the ring-shaped powder compact 30 from the die 31 as shown in FIG. 3F.

If three ring-shaped powder compacts 30 are produced by the aforementioned pressing process and stacked such that outer contours of facing end surfaces of any two adjacent ring-shaped powder compacts 30 match up with each other and sintered together at 1,080° C. and subjected to a heat treatment at 600° C., for example, a preliminary sintered ring magnet is obtained. The sintered ring magnet 10 shown in FIG. 1 is obtained by grinding top and bottom end surfaces and a cylindrical inner surface of the preliminary sintered ring magnet. After grinding, the preliminary sintered ring magnet may be subjected to an anticorrosion surface treatment if necessary.

The sintered ring magnet 10 thus produced is radially magnetized in such a manner that magnetic poles are located on ridges of the individual protrusions 10*b* formed on the generally cylindrical outer surface and, therefore, the sintered ring magnet 10 can be used for producing a high-power motor with reduced cogging torque as previously discussed.

The aforementioned skew angle represents the degree of twisting of corrugations formed on the generally cylindrical outer surface of any of the ring-shaped powder compact, the preliminary sintered ring magnet and the sintered ring magnet. Specifically, the skew angle is an angle between a line segment joining an outermost point of a protrusion on the ring-shaped powder compact, the preliminary sintered ring magnet or the sintered ring magnet in a cross section taken at one position along the axial direction thereof and a line segment joining an outermost point of the protrusion in a cross section taken at another position along the axial direction. As used in the present invention, the expression "skew angle" means the degree of twisting of the corrugations on the ring-shaped powder compact, the preliminary sintered ring magnet or the sintered ring magnet over the total length thereof.

The corrugations formed on the curved inner surface of the die 31 are twisted by the skew angle of 6.87° and the generally cylindrical internal space of the die 31 has the axial length of 16.2 mm as stated earlier. This translates to a skew angle rate of 0.424°/mm. During the pressing process shown in FIG. 3D, the die 31 is compressed to an axial length of 15.55 mm although the skew angle remains at 6.87°, the skew angle rate increasing to 0.44°/mm. When the ring-shaped powder compact 30 released from the die 31 is sintered, the ring-shaped powder compact 30 shrinks by about 16%, reducing to an axial length 13.06 mm, although the skew angle remains unchanged. Thus, the ring-shaped powder compact 30 has a skew angle rate of 0.526°/mm which is approximately equal to the skew angle rate of a final product, or the sintered ring magnet. If three ring-shaped powder compacts 30 are stacked and sintered together, a preliminary sintered ring magnet having an axial length of 39.18 mm and an overall skew angle of 20.61° is obtained. If top and bottom end surfaces of this preliminary sintered ring magnet is finished by grinding, for instance, so that the axial length reduces to 38 mm, the skew angle becomes equal to 20°.

Figure 16:
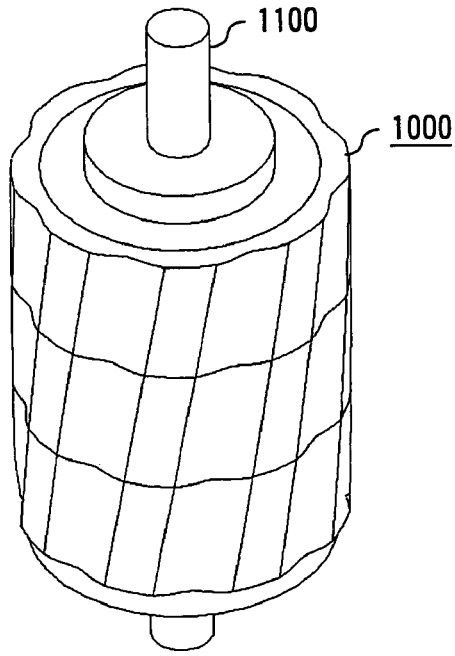
FIG. 16 is a perspective view of a rotor obtained by fitting the sintered ring magnet produced by the second embodiment of the invention onto a shaft.

FIG. 16 is a perspective view of a rotor 1000 obtained by bonding the sintered ring magnet 10 thus produced onto a shaft 1100 and grinding specific portions of the generally cylindrical outer surface of the ring magnet 10 using a central axis of the shaft 1100 as an axis of reference. More specifically, as viewed along the central axis of the shaft 1100, each of the ground portions of the sintered ring magnet constituting outermost surfaces thereof forms part of a circle (or an arc segment in cross section) of which center lies on the central axis of the shaft 1100.

Since the outermost surfaces of the sintered ring magnet of the rotor 1000 are finished (ground) using the central axis of the shaft 1100 as the axis of reference, shaping errors of the outermost surfaces of the sintered ring magnet are half or less of shaping errors of the outermost surfaces of the sintered ring magnet 10 shown in FIG. 1 so that roundness, or cylindricality, of the outermost surfaces of the sintered ring magnet is greatly increased. Additionally, concentricity value of the outermost surfaces of the sintered ring magnet of the rotor 1000 with respect to the central axis of the shaft 1100 can be reduced to one-half or less, so that an air gap created between the sintered ring magnet of the rotor 1000 and a stator can be reduced to one-half or less compared to an air gap created between the sintered ring magnet 10 of FIG. 1 and a stator. The rotor 1000 of the present embodiment can be used for manufacturing a high-power, high-efficiency motor capable of producing an increased torque.

Second Embodiment

Figure 8A:
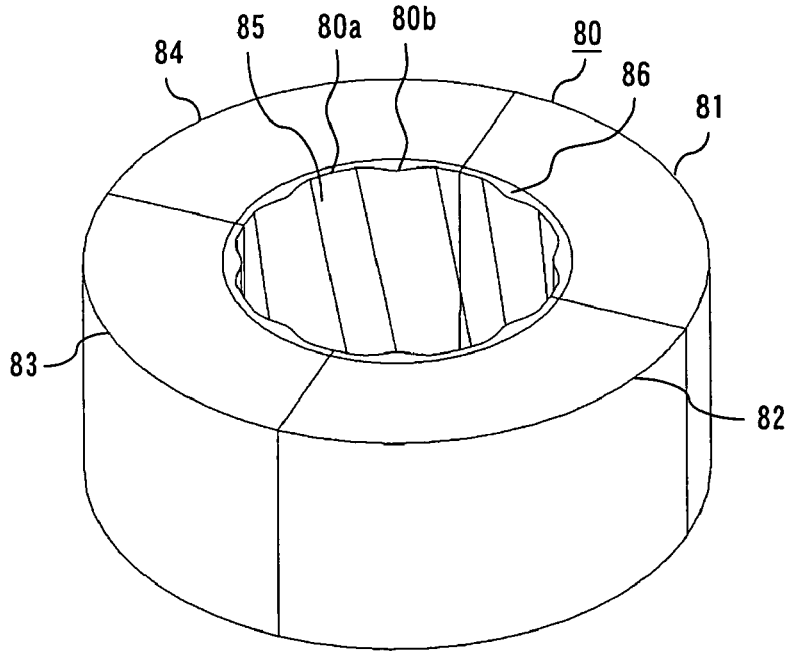
FIGS. 8A and 8B are perspective views of a die used in a ring magnet manufacturing apparatus and method according to a second embodiment of the invention.
Figure 8B:
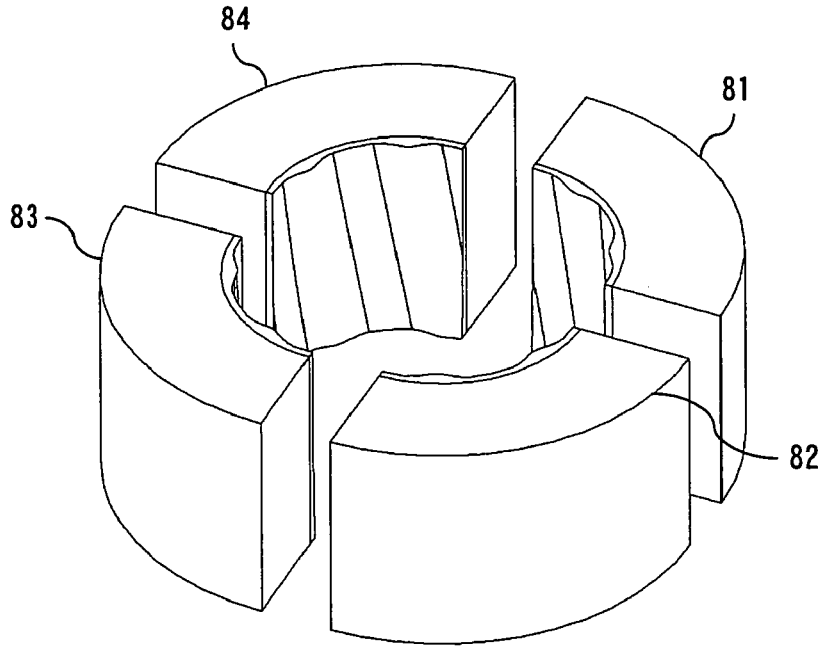

FIGS. 8A and 8B are perspective views of a die 80 of a ring magnet pressing unit (metal die unit) used in a ring magnet manufacturing apparatus and method according to a second embodiment of the invention. As shown in FIGS. 8A and 8B, the die 80 used in the second embodiment is made by combining four arch-shaped members 81-84 into a ring form. Referring to FIG. 8A, in which the arch-shaped members 81-84 are combined, a curved inner surface of the die 80 (which constitutes a curved outer surface of a cavity formed in the die 80) is corrugated with eight each hollows 80*a* and protrusions 80*b* alternately formed at regular angular intervals (45°). These corrugations are inclined by a skew angle of 6.9° about an axial direction of the die 80. The die 80 has an axial length of 26 mm, a maximum inside diameter of 43 mm as measured between outermost points of any two opposite hollows 80*a* and a minimum inside diameter of 42 mm as measured between innermost points of any two opposite protrusions 80*b*. A core (not shown) has an outside diameter of 33 mm. The difference in height between the outermost points of the hollows 80*a* and the innermost points of the protrusions 80*b* is 1 mm. As viewed along the axial direction of the die 80, an outermost portion of each of the hollows 80*a* forms part of a circle (or an arc segment 85 in cross section) of which center lies on a central axis of a generally cylindrical inner surface of the die 80.

Figure 15:
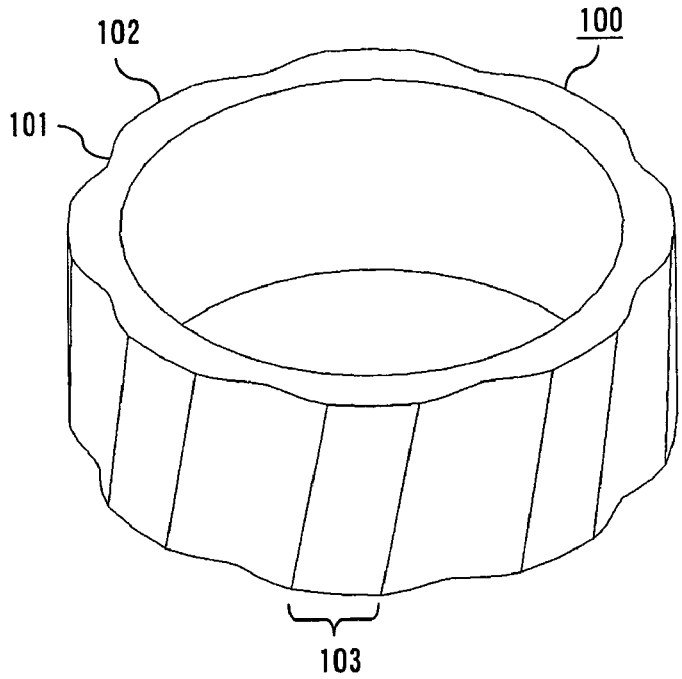
FIG. 15 is a perspective view of the ring-shaped powder compact pressed by the die of the second embodiment of the invention.

A ring-shaped powder compact 100 shown in FIG. 15 can be pressed by using the aforementioned die 80. The ring-shaped powder compact 100 has a generally cylindrical outer surface with surface corrugations formed thereon by alternating hollows 101 and protrusions 102 along the ring-shaped powder compact 100. Eight each hollows 101 and the protrusions 102 run in parallel lines which are skewed by a specific angle with respect to an axial direction of the ring-shaped powder compact 100. As viewed along the axial direction of the ring-shaped powder compact 100, each of outermost surfaces of the ring-shaped powder compact 100, or outermost portions of the eight protrusions 102, forms part of a circle (or an arc segment 103 in cross section) of which center lies on a central axis of the ring-shaped powder compact 100.

Now, a pressing process for making the ring-shaped powder compact 100 according to the second embodiment of the invention is explained. FIGS. 9-13 are perspective views schematically showing the pressing process for making the ring-shaped powder compact 100 according to the second embodiment. Among the four arch-shaped members 81-84 of the die 80, the arch-shaped member 82 is not shown in FIGS. 9-13 to facilitate understanding of statuses within the metal die unit.

As shown in FIGS. 8A and 8B, the die 80 is built by combining the four arch-shaped members 81-84 which are formed as if by dividing a ring-shaped structure of ferromagnetic material into four equal arch-shaped parts. Nonmagnetic members 86 having a minimum wall thickness of 1 mm are bonded to curved inner surfaces of the individual arch-shaped members 81-84. The aforementioned corrugations (the hollows 80*a* and the protrusions 80*b*) are formed on curved inner surfaces of the individual nonmagnetic members 86.

Figure 9:
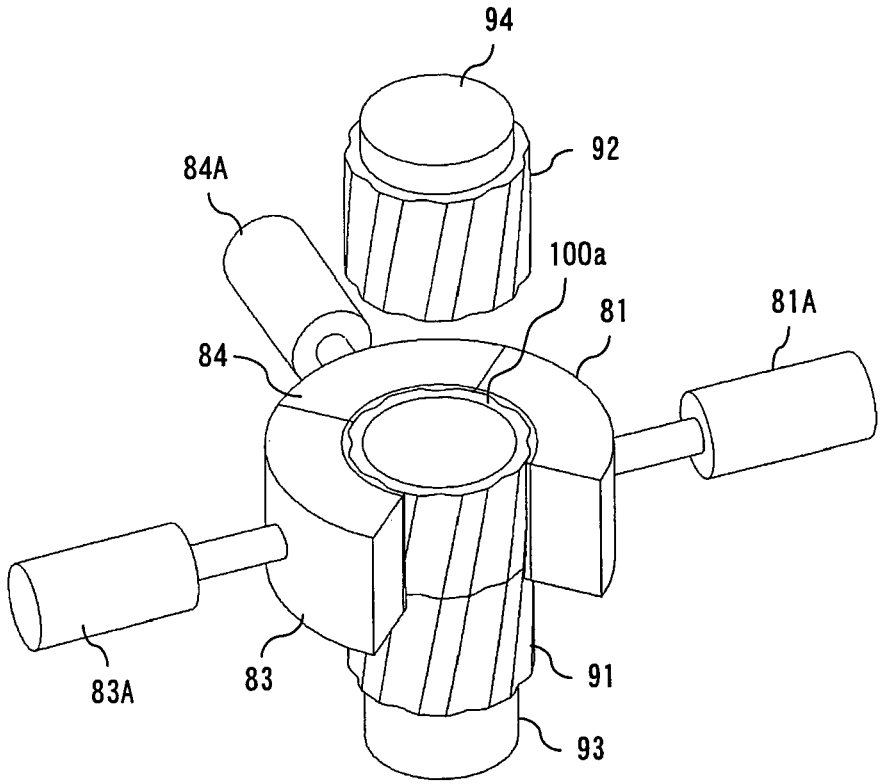
FIG. 9 is a perspective view showing a status of a ring magnet pressing unit during execution of a ring-shaped powder compact pressing process according to the second embodiment.

Referring to FIG. 9, direct-acting mechanisms 81A, 82A, 83A, 84A driven by hydraulic cylinders are attached to curved outer surfaces of the arch-shaped members 81, 82, 83, 84 of the die 80, respectively, so that the arch-shaped members 81, 82, 83, 84 can be moved in radial directions. The ring magnet pressing unit includes a lower punch 91 and an upper punch 92 of which curved outer surfaces are corrugated with protrusions and hollows which fit along the hollows 80*a* and the protrusions 80*b* formed on the curved inner surface of the die 80. The corrugations (protrusions and hollows) on the curved outer surfaces of the lower and upper punches 91, 92 are separated from the corrugations (the hollows 80*a* and the protrusions 80*b*) on the curved inner surface of the die 80 by a clearance of 0.01 to 0.04 mm. Although not illustrated, the upper punch 92 is made movable along the axial direction by means of a motor and ball screw for pressurizing magnetic powder 100*a* which will be filled into the cavity formed in the die 80. Additionally, the upper punch 92 is caused to rotate about its longitudinal axis by a servomotor at a rate corresponding to the skew angle of the corrugations formed on the curved inner surface of the die 80 in synchronism with movement along the axial direction. In the second embodiment of the invention, the upper punch 92 is controlled to rotate 9.6° clockwise while the upper punch 92 moves 26 mm downward in the axial direction. The upper punch 92 is initially set at such an angular position that an inner contour of an upper end of the die 80 aligns with an outer contour of a lower end of the upper punch 92 when the lower end of the upper punch 92 descends to the same level as the upper end of the die 80.

The magnetic powder 100*a* is produced in the same way as discussed earlier with reference to the first embodiment. The pressing process of the second embodiment of the invention is now described in detail. First, the four arch-shaped members 81, 82, 83, 84 are forced toward the central axis by the direct-acting mechanisms 81A, 82A, 83A, 84A, respectively, so that the die 80 is held in a ring form as shown in FIG. 8A. The aforementioned cavity is formed by the die 80, a lower core section 93 made of ferromagnetic material and the lower punch 91 made of nonmagnetic material. Then, the magnetic powder 100*a* is filled into the cavity by a powder feeder. FIG. 9 shows the status of the metal die unit at this point.

Figure 10:
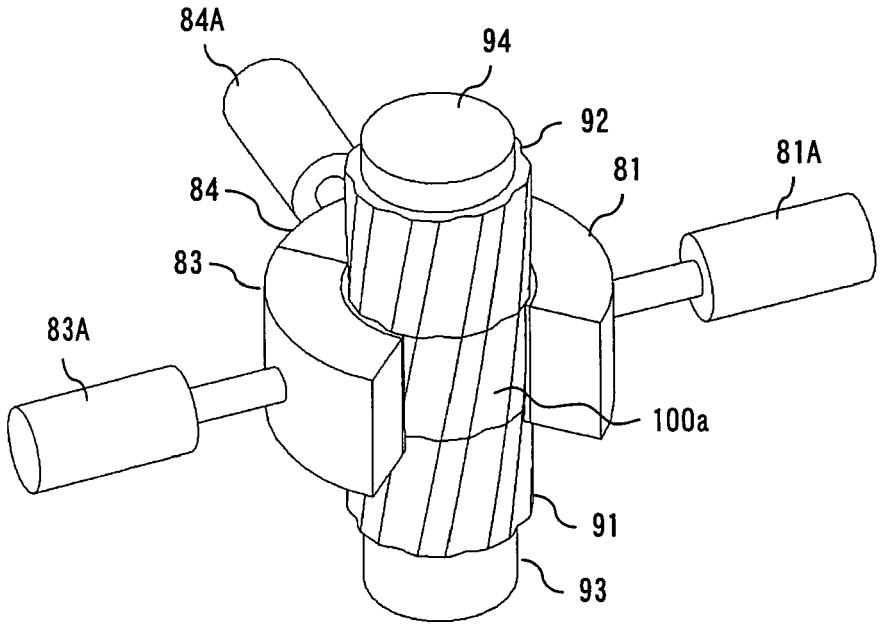
FIG. 10 is a perspective view showing a status of the ring magnet pressing unit during execution of the ring-shaped powder compact pressing process according to the second embodiment.

Next, the upper punch 92 made of nonmagnetic material and an upper core section 94 made of ferromagnetic material descend together as shown in FIG. 10 and, with the cavity closed, a radially orienting magnetic field is applied to the magnetic powder 100*a*. At this point, the lower and upper cores 93, 94 are in mutual contact, together forming part of a magnetic path.

Figure 11:
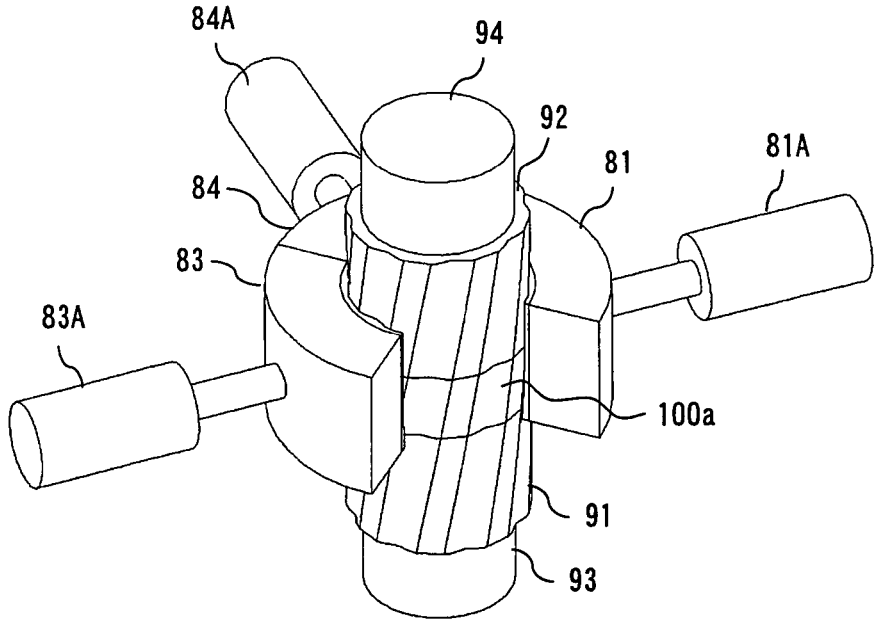
FIG. 11 is a perspective view showing a status of the ring magnet pressing unit during execution of the ring-shaped powder compact pressing process according to the second embodiment.

Next, the upper punch 92 descends while turning at the rate corresponding to the skew angle of the corrugations on the die 80, compressing thereby the magnetic powder 100*a* filled in the cavity to form a ring-shaped powder compact 100, as shown in FIG. 11. Here, the lower punch 91 may be caused to ascend while turning at the same time. The ring-shaped powder compact 100 can be formed with increased shape accuracy if the magnetic powder 100*a* is compressed by both the lower and upper punches 91, 92. This is because the density of the ring-shaped powder compact 100 becomes uniform if simultaneously compressed from both top and bottom.

Figure 12:
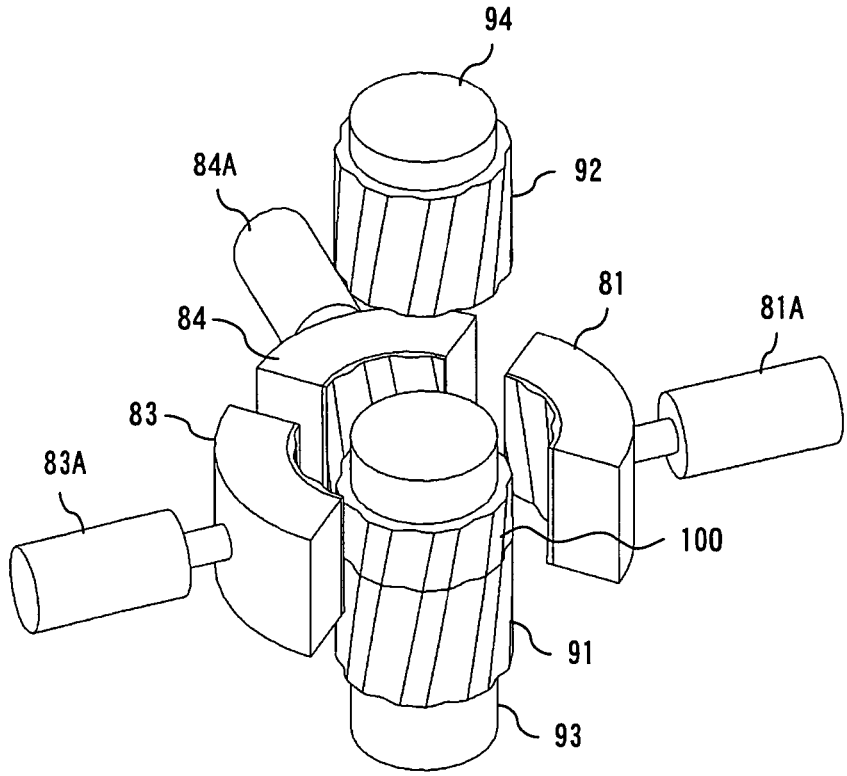
FIG. 12 is a perspective view showing a status of the ring magnet pressing unit during execution of the ring-shaped powder compact pressing process according to the second embodiment.

Subsequently, the upper punch 92 and the upper core section 94 are raised while causing the upper punch 92 to rotate about its longitudinal axis and the four arch-shaped members 81, 82, 83, 84 constituting the die 80 are moved radially outward by the hydraulic cylinder-operated direct-acting mechanisms 81A, 82A, 83A, 84A as shown in FIG. 12. The arch-shaped members 81, 82, 83, 84 are to be moved by a distance larger than the difference in height between the outermost points of the hollows 80*a* and the innermost points of the protrusions 80*b* formed on the curved inner surface of the die 80. As the arch-shaped members 81, 82, 83, 84 of the die 80 are separated from a curved outer surface of the ring-shaped powder compact 100 in this way, a compressive stress in the ring-shaped powder compact 100 is uniformly released and, therefore, the ring-shaped powder compact 100 would not easily break as a result of the die release operation.

Figure 13:
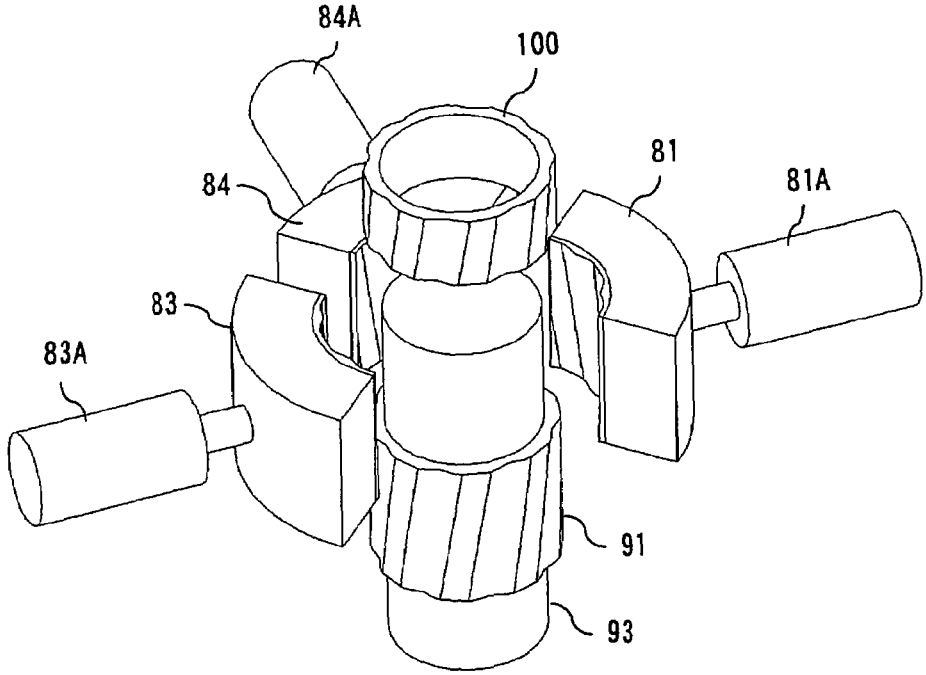
FIG. 13 is a perspective view showing a status of the ring magnet pressing unit during execution of the ring-shaped powder compact pressing process according to the second embodiment.

Finally, the ring-shaped powder compact 100 is released from the lower core section 93 as shown in FIG. 13, whereby the ring-shaped powder compact 100 shaped as shown in FIG. 15 is obtained. Because the compressive stress in the ring-shaped powder compact 100 is released and the ring-shaped powder compact 100 enlarges in diameter due to spring back when the arch-shaped members 81, 82, 83, 84 of the die 80 are moved radially outward, there is created a clearance between the lower core section 93 and the ring-shaped powder compact 100. Furthermore, when the arch-shaped members 81, 82, 83, 84 of the die 80 are moved radially outward, there is also created a clearance between outermost points of the protrusions 102 of the ring-shaped powder compact 100 and the innermost points of the protrusions 80*b* of the die 80, so that the ring-shaped powder compact 100 can be easily released from the lower core section 93.

Figure 14:
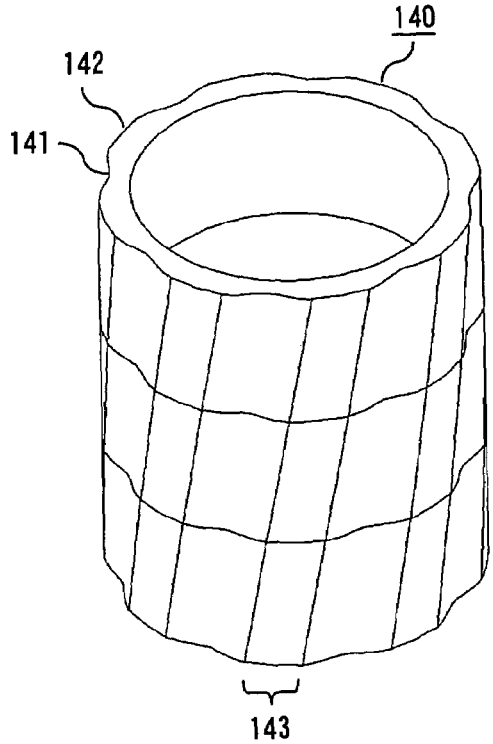
FIG. 14 is a perspective view of a sintered ring magnet produced by the second embodiment of the invention.

If three ring-shaped powder compacts 100 are produced by the aforementioned pressing process and stacked such that outer contours of facing end surfaces of any two adjacent ring-shaped powder compacts 100 match up with each other and sintered together at 1,080° C. and subjected to heat treatment at 600° C., for example, a preliminary sintered ring magnet is obtained. Top and bottom end surfaces and a cylindrical inner surface of the preliminary sintered ring magnet as well as an outermost portion of each of the protrusions forming part of a circle (or an arc segment 143 in cross section) on the corrugated outer surface of the ring-shaped powder compacts 100 are ground to obtain a finished sintered ring magnet 140 having hollows 141 and protrusions 142 on a generally cylindrical outer surface as shown in FIG. 14. After grinding, the preliminary sintered ring magnet may be subjected to an anticorrosion surface treatment if necessary.

As thus far discussed, each of outermost surfaces of the sintered ring magnet 140, or the outermost portions of the eight protrusions 142, forms part of the circle (or the arc segment 143 in cross section) of which center lies on a central axis of the sintered ring magnet 140. Since the individual arc segments 143 of the sintered ring magnet 140 are finished by grinding after sintering, the sintered ring magnet 140 has a high degree of shape accuracy. While the sintered ring magnet 140 of the second embodiment has the same advantages as the sintered ring magnet of the first embodiment, the generally cylindrical outer surface of the sintered ring magnet 140 of the second embodiment has greater dimensional accuracy and geometrical accuracy (in terms of concentricity, roundness and cylindricality with respect to the central axis of the sintered ring magnet 140). Accordingly, when incorporated into a motor, the sintered ring magnet 140 of the second embodiment makes it possible to reduce an air gap between the ring magnet 140 and a stator core and, as a consequence, increase the amount of torque generated by the motor.

This sintered ring magnet 140 is radially magnetized such that individual magnetic poles are formed along lines each of which connects circumferential midpoints of the outermost portion of the protrusion 142 (arc segment 143 in cross section) formed on the generally cylindrical outer surface and, therefore, the sintered ring magnet 140 can be used for producing a high-power motor with reduced cogging torque as previously discussed.

The above-described ring magnet manufacturing apparatus and method of the second embodiment can be used for producing the sintered ring magnet 10 of the first embodiment shown in FIG. 1. Unlike the sintered ring magnet 140 of the second embodiment, however, outermost portions of the generally cylindrical outer surface of the sintered ring magnet 10 of the first embodiment are not finished (ground).

Third Embodiment

Figure 17:
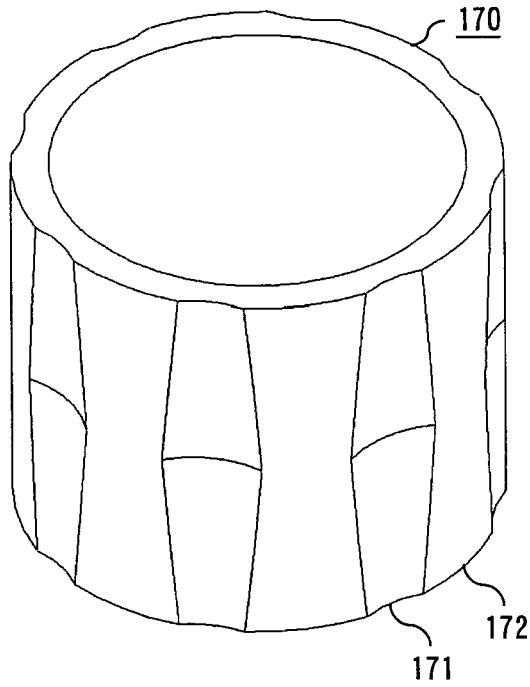
FIG. 17 is a perspective view of a sintered ring magnet produced by a manufacturing apparatus and method according to a third embodiment of the invention.

FIG. 17 is a perspective view of a sintered ring magnet 170 produced by a ring magnet manufacturing apparatus and method according to a third embodiment of the invention. The sintered ring magnet 170 of FIG. 17 is an 8-pole ring magnet having corrugations (alternating hollows 171 and protrusions) formed at regular intervals around a generally cylindrical outer surface thereof. As viewed along a longitudinal axis (central axis) of the ring magnet 170, outermost portions of the protrusions of the ring magnet 170 each form part of a circle (or an arc segment 172 in cross section) of which center lies on a central axis of a cylindrical inner surface of the ring magnet 170, or on the central axis of the ring magnet 170. The cross-sectional shape of the sintered ring magnet 170 varies with the position of the cross section along the central axis of the ring magnet 170. Specifically, the hollows 171 formed on the outer surface of the sintered ring magnet 170 become narrower and shallower toward both ends of the sintered ring magnet 170 along the central axis thereof, wider and deeper toward a mid-length position along the central axis. Boundaries of magnetic poles (eight poles in total in the example of FIG. 17) are located in the hollows 171.

A ring-shaped powder compact for producing the sintered ring magnet 170 of FIG. 17 is pressed by using a die which is essentially similar to the die 31 of the first embodiment or the die 80 of the second embodiment except for the shape of corrugations formed on a generally cylindrical inner surface of the die. Specifically, the generally cylindrical inner surface of the die of the third embodiment is corrugated with hollows and protrusions alternately formed at regular intervals in a circumferential direction. As viewed along an axial direction of the die, an outermost portion of each of the hollows forms part of a circle (or an arc segment in cross section) of which center lies on a central axis of the generally cylindrical inner surface of the die. The protrusions formed on the inner surface of the die become narrower and lower toward both ends of the die along the central axis thereof, wider and higher toward a mid-length position along the central axis. A ring-shaped powder compact pressing process and a ring magnet manufacturing process of the third embodiment are essentially the same as discussed with reference to the aforementioned first or second embodiment.

In the ring magnet 170 produced by the manufacturing process of the third embodiment, each of the hollows 171, as seen in cross section, forms part of an ellipse of which major axis and minor axis become shorter from the mid-length position of the ring magnet 170 toward both ends thereof in proportion to the distance from the mid-length position. The hollows 171 are shaped such that the ratio of the sum of the widths of the hollows 171 along a circumferential direction (rotating direction) of the ring magnet 170 to the circumference thereof varies from 80% to 20% and the depth of the hollows 171 varies from 80% to 20% with the distance from the mid-length position. The ring magnet 170 of FIG. 17 can suppress fifth and seventh harmonic components of a sine-wave fundamental component caused by a magnetomotive force distribution to 45% and 60% or less, respectively, compared to harmonic components of a rectangular magnetomotive force distribution pattern produced by a ring magnet having no surface corrugations. Hence, it is possible to suppress harmonic components due to distortion of the magnetomotive force distribution pattern, which is a causal factor of cogging torque, and thereby reduce the cogging torque.

In the case of the sintered ring magnet 170 of FIG. 17 shaped as described above, the hollows 171 formed in areas of the generally cylindrical outer surface of the ring magnet 170 which are not part of the circle as seen in cross section (or the arc segment 172) constitute relatively deep parallel grooves. Even if the hollows 171 are formed with low precision and there are variations in the depth of the hollows 171, the ring magnet 170 can be configured such that cumulative sums of magnetomotive forces along the axial direction are distributed in a pattern resembling a sine-wave distribution pattern in the rotating direction with high precision. Therefore, it is possible to achieve a great cogging torque reduction effect.

The sintered ring magnet 170 shown in FIG. 17 is an example of a ring magnet in which the hollows 171 are symmetrically formed from the mid-length position of the ring magnet 170 toward both ends thereof. The ring magnet 170 thus configured is well balanced about a center of gravity and, therefore, the ring magnet 170 has an advantage that the same can reduce acoustic noise and vibrations when used in a motor.

While the sintered ring magnet 170 of FIG. 17 is symmetrical about the mid-length position thereof, the embodiment may be modified such that each of the hollows 171 is wide at one end of the ring magnet 170 along the longitudinal axis thereof and narrow at the opposite end, for example, yet producing the same cogging torque reduction effect as discussed above.

Figure 18:
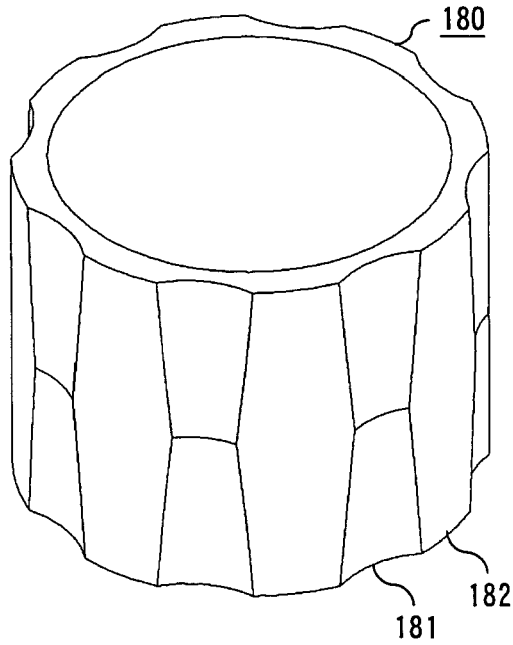
FIG. 18 is a perspective view of a sintered ring magnet produced by a manufacturing apparatus and method in one modified form of the third embodiment of the invention.

FIG. 18 is a perspective view of a sintered ring magnet 180 produced by a ring magnet manufacturing apparatus and method in one modified form of the fifth embodiment of the invention. What is characteristic of the sintered ring magnet 180 of FIG. 18 is that hollows 181 formed on the outer surface of the sintered ring magnet 180 become wider and deeper toward both ends of the sintered ring magnet 180 along the central axis thereof, narrower and shallower toward the mid-length position along the central axis. In the ring magnet 180 of FIG. 18, each of the hollows 181, as seen in cross section, forms part of an ellipse of which major axis and minor axis become longer from the mid-length position of the ring magnet 180 toward both ends thereof in proportion to the distance from the mid-length position. The sintered ring magnet 180 of FIG. 18 thus shaped can also produce the same advantageous effect as discussed above.

A ring-shaped powder compact for producing the sintered ring magnet 180 of FIG. 18 is pressed by using a die which is essentially similar to the die 31 of the first embodiment or the die 80 of the second embodiment except for the shape of corrugations formed on a generally cylindrical inner surface of the die. Specifically, the generally cylindrical inner surface of the die of this modified form of the third embodiment is corrugated with hollows and protrusions alternately formed at regular intervals in a circumferential direction. As viewed along an axial direction of the die, an outermost portion of each of the hollows forms part of a circle (or an arc segment in cross section) of which center lies on a central axis of the generally cylindrical inner surface of the die. The protrusions formed on the inner surface of the die become wider and higher toward both ends of the die along the central axis thereof, narrower and lower toward a mid-length position along the central axis.

Fourth Embodiment

Figure 19:
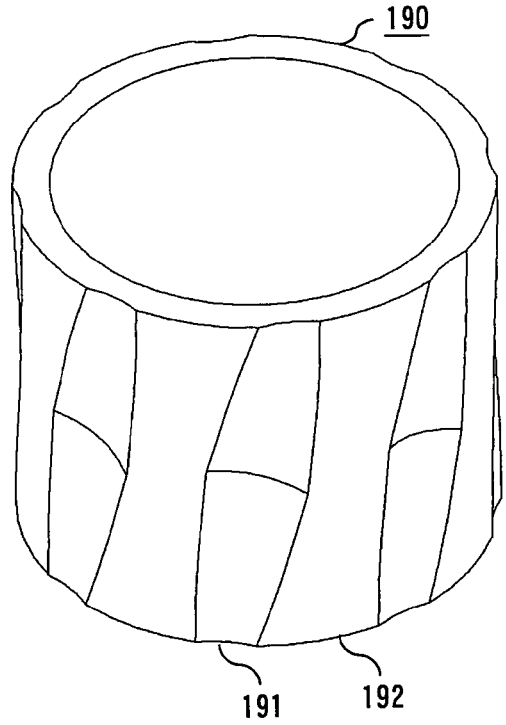
FIG. 19 is a perspective view of a sintered ring magnet produced by a manufacturing apparatus and method according to a fourth embodiment of the invention.

FIG. 19 is a perspective view of a sintered ring magnet 190 produced by a ring magnet manufacturing apparatus and method according to a fourth embodiment of the invention. The sintered ring magnet 190 of FIG. 19 is an 8-pole ring magnet having corrugations (alternating hollows 191 and protrusions) formed at regular intervals around a generally cylindrical outer surface thereof. As viewed along a rotational axis (central axis) of the ring magnet 190, outermost portions of the protrusions of the ring magnet 190 each form part of a circle (or an arc segment 192 in cross section) of which center lies on the central axis of the ring magnet 190. As is the case with the ring magnet 170 of the third embodiment shown in FIG. 17, the cross-sectional shape of the ring magnet 190 taken by a plane perpendicular to the central axis thereof varies with the position of the cross section along the central axis of the ring magnet 190. While the corrugations formed on the ring magnet 190 are shaped like the ring magnet 170 of FIG. 17 in cross section as viewed along the central axis, the corrugations of the ring magnet 190 are skewed as illustrated in FIG. 19. Magnetic poles (eight poles in total in the example of FIG. 19) of the sintered ring magnet 190 are formed by skewed magnetization and boundaries of the magnetic poles are located in the hollows 191.

A ring-shaped powder compact for producing the sintered ring magnet 190 of FIG. 19 is pressed by using a die which is essentially similar to the die 31 of the first embodiment or the die 80 of the second embodiment except for the shape of corrugations formed on a generally cylindrical inner surface of the die. Specifically, the generally cylindrical inner surface of the die of the fourth embodiment is corrugated with hollows and protrusions alternately formed at regular intervals in a circumferential direction. As viewed along an axial direction of the die, an outermost portion of each of the hollows forms part of a circle (or an arc segment in cross section) of which center lies on a central axis of the generally cylindrical inner surface of the die. The protrusions formed on the inner surface of the die become narrower and lower toward both ends of the die along the central axis thereof, wider and higher toward a mid-length position along the central axis. The hollows and the protrusions formed on the inner surface of the die are skewed about the central axis thereof. A ring-shaped powder compact pressing process and a ring magnet manufacturing process of the fourth embodiment are essentially the same as discussed with reference to the aforementioned first or second embodiment.

The sintered ring magnet 190 of the fourth embodiment can reduce distortion of a magnetomotive force distribution. When incorporated in a motor, the sintered ring magnet 190 serves to reduce torque fluctuations, such as cogging torque and torque ripple, by virtue of skewed magnetization design. In this embodiment, a cogging torque reduction effect is obtained at a skew angle of 15° or 18°. Compared to an ordinary ring magnet, the sintered ring magnet 190 of the embodiment can reduce cogging torque to ⅓ or less.

Figure 20:
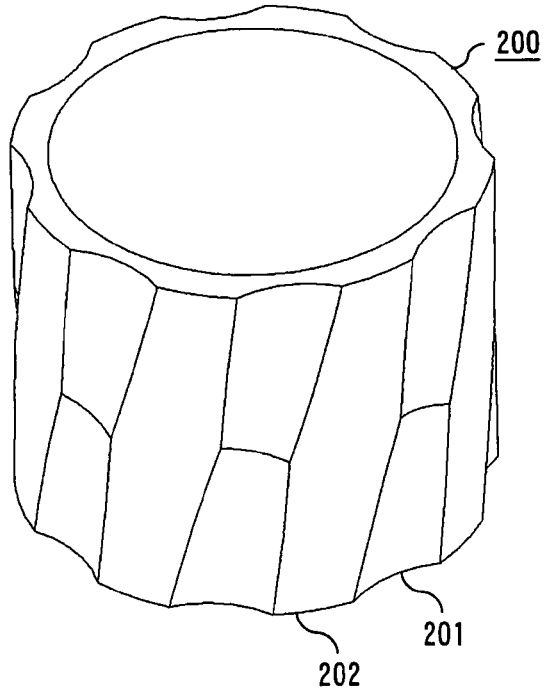
FIG. 20 is a perspective view of a sintered ring magnet produced by a manufacturing apparatus and method in one modified form of the fourth embodiment of the invention.

FIG. 20 is a perspective view of a sintered ring magnet 200 produced by a ring magnet manufacturing apparatus and method in a modified form of the fourth embodiment of the invention. The sintered ring magnet 200 of FIG. 20 is an 8-pole ring magnet having corrugations (alternating hollows 201 and protrusions) formed at regular intervals around a generally cylindrical outer surface thereof. As viewed along a rotational axis (central axis) of the ring magnet 200, outermost portions of the protrusions of the ring magnet 200 each form part of a circle (or an arc segment 202 in cross section) of which center lies on the central axis of the ring magnet 200. As is the case with the ring magnet 180 of the third embodiment shown in FIG. 18, the cross-sectional shape of the ring magnet 200 taken by a plane perpendicular to the central axis thereof varies with the position of the cross section along the central axis of the ring magnet 200. While the corrugations formed on the ring magnet 200 are shaped like the ring magnet 180 of FIG. 18 in cross section as viewed along the central axis, the corrugations of the ring magnet 200 are skewed as illustrated in FIG. 20. Magnetic poles (eight poles in total in the example of FIG. 20) of the sintered ring magnet 200 are formed by skewed magnetization and boundaries of the magnetic poles are located in the hollows 201. The sintered ring magnet 200 of FIG. 20 thus shaped can also produce the same advantageous effect as discussed above.

Figure 21:
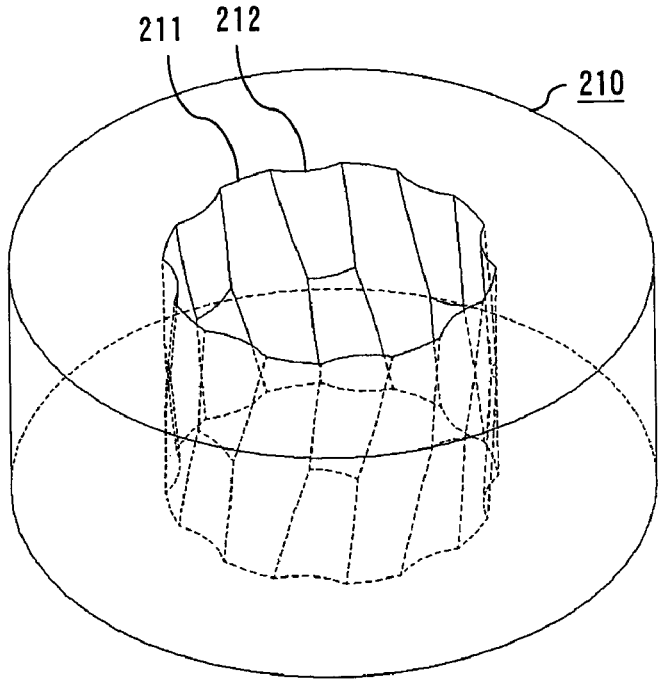
FIG. 21 is a perspective view of the die used in the fourth embodiment of the invention.

A ring-shaped powder compact for producing the sintered ring magnet 200 of FIG. 20 is pressed by using a ring-shaped die 210 which is essentially similar to the die 31 of the first embodiment or the die 80 of the second embodiment except for the shape of corrugations formed on a generally cylindrical inner surface of the die 210. FIG. 21 is a perspective view of the die 210 used in the fourth embodiment of the invention. Like the die 31 of the first embodiment, the die 210 shown in FIG. 21 is a die made of silicone rubber having elasticity. The generally cylindrical inner surface of the die 210 of this modified form of the fourth embodiment is corrugated with hollows and protrusions 212 alternately formed at regular intervals in a circumferential direction. As viewed along an axial direction of the die 210, an outermost portion of each of the hollows forms part of a circle (or an arc segment 211 in cross section) of which center lies on a central axis of the generally cylindrical inner surface of the die 210. The protrusions 212 formed on the inner surface of the die 210 become wider and higher toward both ends of the die 210 along the central axis thereof, narrower and lower toward a mid-length position along the central axis. The hollows and the protrusions formed on the inner surface of the die 210 are skewed about the central axis thereof by a specific angle.

Fifth Embodiment

Figure 22:
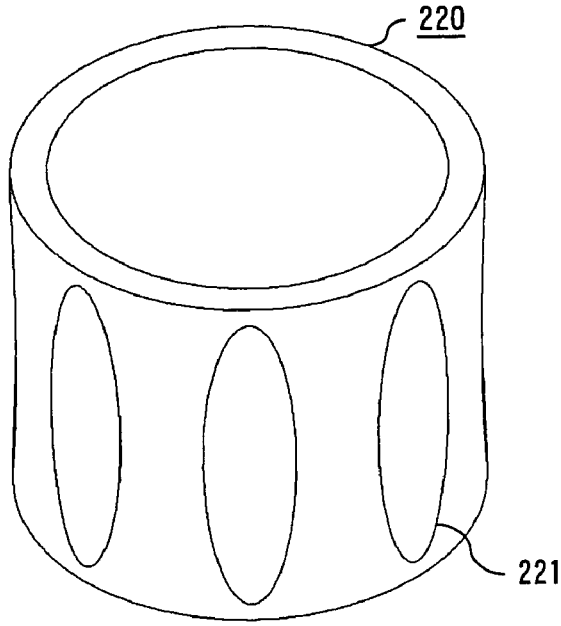
FIG. 22 is a perspective view of a sintered ring magnet produced by a manufacturing apparatus and method according to a fifth embodiment of the invention.

FIG. 22 is a perspective view of a sintered ring magnet 220 produced by a ring magnet manufacturing apparatus and method according to a fifth embodiment of the invention. There are formed oval-shaped hollows 221 in specific areas of a generally cylindrical outer surface of the sintered ring magnet 220 along an axial direction thereof, both axial ends of the ring magnet 220 having a circle-shaped outer periphery in cross section perpendicular to the axial direction. The ring magnet 220 is otherwise shaped essentially in same fashion as the sintered ring magnet 190 of the fourth embodiment.

The sintered ring magnet 220 of FIG. 22 generates a larger amount of magnetic flux so that, when incorporated in a motor, the ring magnet 220 helps produce a greater output power while suppressing cogging torque. Additionally, the ring magnet 220 of FIG. 22 serves to reduce the amount of exciting current and thereby improve motor efficiency. Moreover, the ring magnet 220 features greater mechanical strength.

Figure 29:
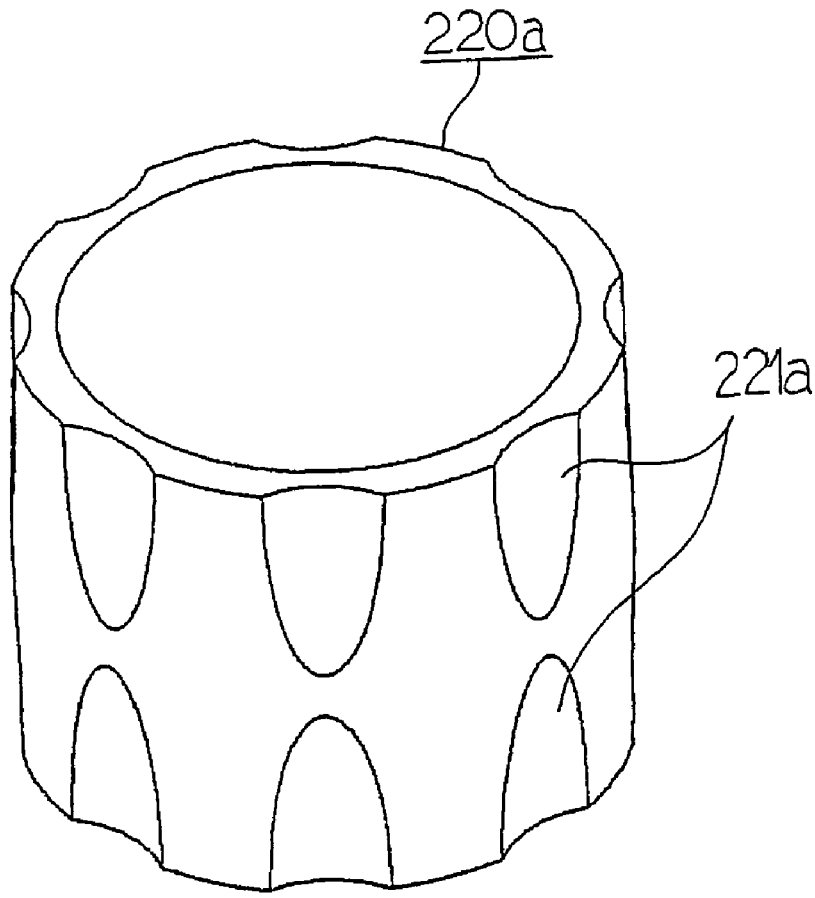
FIG. 29 is a perspective view of a sintered ring magnet produced by a manufacturing apparatus and method in another modified form of the fifth embodiment of the invention.

The aforementioned advantages of the ring magnet 220 of FIG. 22 are obtained when the areas where the oval-shaped hollows 221 are formed are 5% to 30% of the longitudinal length of the ring magnet 220. While FIG. 22 shows an example in which the oval-shaped hollows 221 are formed such that both axial ends of the ring magnet 220 has a circle-shaped outer periphery in cross section perpendicular to the axial direction, the ring magnet 220 may be modified as illustrated in FIG. 29. Specifically, in this modified form of the fifth embodiment, a sintered ring magnet 220*a* shown in FIG. 29 has semielliptical hollows 221*a* formed in a generally cylindrical outer surface thereof in such a fashion that short axes (or long axes) of the semielliptical hollows 221*a* lie at both axial ends of the ring magnet 220*a*, intersecting points of the semielliptical hollows 221*a* and the respective long axes (or short axes) are located to close to the a mid-length position of the ring magnet 220*a*, and a cross section of the ring magnet 220*a* taken by a plane perpendicular to a central axis thereof at the mid-length position along the central axis is circle-shaped.

Figure 23:
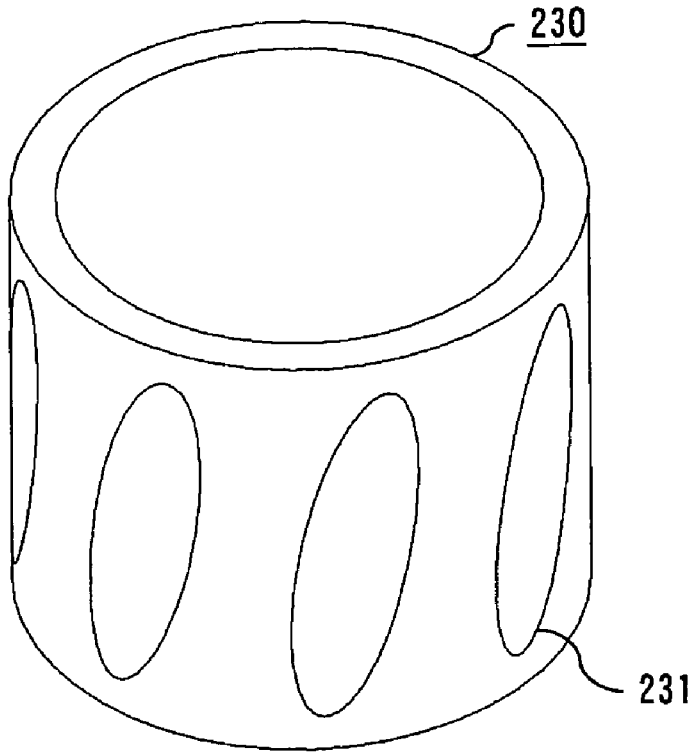
FIG. 23 is a perspective view of a sintered ring magnet produced by a manufacturing apparatus and method in one modified form of the fifth embodiment of the invention.
Figure 24A:
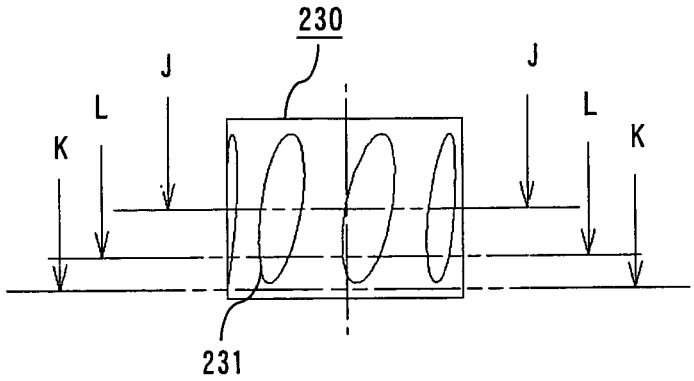
FIGS. 24A-24D are diagrams showing cross-sectional shapes of the sintered ring magnet of FIG. 23.
Figure 24B:
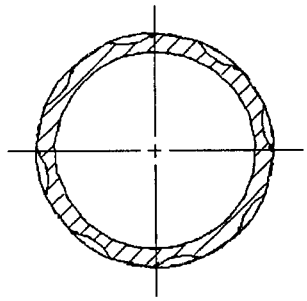
Figure 24C:
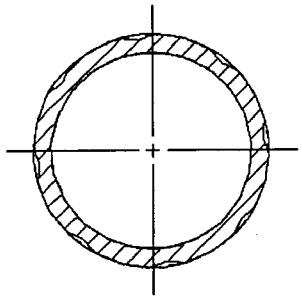
Figure 24D:
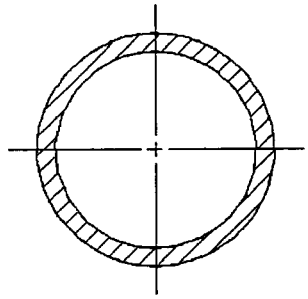

FIG. 23 is a perspective view of a sintered ring magnet 230 produced by a ring magnet manufacturing apparatus and method in another modified form of the fifth embodiment of the invention. What is characteristic of the sintered ring magnet 230 of FIG. 23 is that oval-shaped hollows 231 are formed in specific areas of a generally cylindrical outer surface of the ring magnet 230 and these hollows 231 are skewed with respect to an axial direction of the ring magnet 230. Therefore, the ring magnet 230 of FIG. 23 has an advantage that the cogging torque can be further suppressed by virtue of skewed magnetization design in addition to the aforementioned advantages of the fifth embodiment. FIGS. 24A-24D are diagrams showing cross-sectional shapes of the sintered ring magnet 230 of FIG. 23.

A ring-shaped powder compact for producing the sintered ring magnet 220 of FIG. 22 or the sintered ring magnet 230 of FIG. 23 is pressed by using a die which is essentially similar to the die 31 of the first embodiment or the die 80 of the second embodiment except for the shape of corrugations formed on a generally cylindrical inner surface of the die. Specifically, the generally cylindrical inner surface of the die of the fifth embodiment for producing the sintered ring magnet 220 of FIG. 22 has oval-shaped protrusions of which long axes run parallel to an axial direction of the die. The cylindrical inner surface of the die of the modified form of the fifth embodiment for producing the sintered ring magnet 230 of FIG. 23 also has oval-shaped protrusions but these protrusions are skewed about a central axis of the die by a specific angle.

Sixth Embodiment

Figure 25:
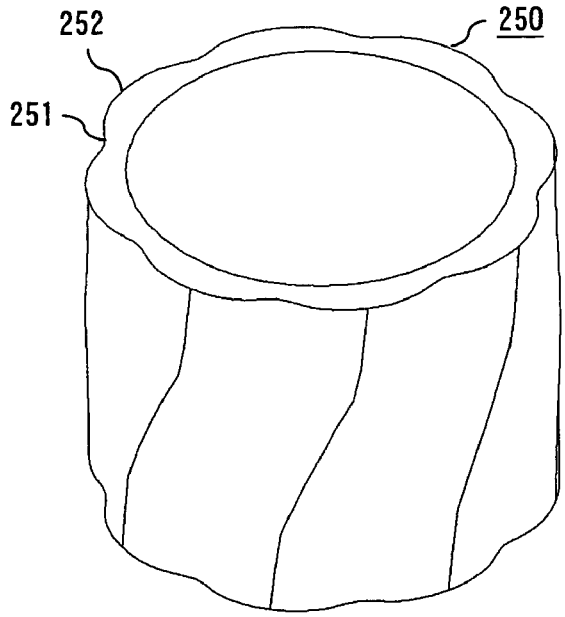
FIG. 25 is a perspective view of a sintered ring magnet produced by a manufacturing apparatus and method according to a sixth embodiment of the invention.

FIG. 25 is a perspective view of a sintered ring magnet 250 produced by a ring magnet manufacturing apparatus and method according to a sixth embodiment of the invention.

Generally, magnetic flux generated by a ring magnet does not reach a stator in its entirety but part of the magnetic flux departing from longitudinal end portions of the ring magnet passes through a gap between the ring magnet and the stator and returns to the ring magnet. Consequently, the amount of effectively working magnetic flux decreases at the longitudinal end portions of the ring magnet. Although skewed magnetization whereby magnetic poles are formed at an oblique angle to an axial direction of the ring magnet produces a cogging torque reduction effect when the magnetic flux is uniformly generated, the cogging torque reduction effect lessens when the generated magnetic flux is not uniformly distributed.

To compensate for a reduction in the amount of magnetic flux at longitudinal end portions of the sintered ring magnet 250, the ring magnet 250 of the sixth embodiment shown in FIG. 25 has corrugations formed by alternating hollows 251 and protrusions 252 on a generally cylindrical outer surface, wherein the corrugations are skewed about a central axis of the ring magnet 250 with skew angle of the corrugations becoming smaller toward both axial ends of the ring magnet 250. The ring magnet 250 is magnetized such that boundaries of magnetic poles become nearly parallel to the central axis of the ring magnet 250 as seen from outside the generally cylindrical outer surface thereof. This structure of the ring magnet 250 makes it possible to compensate for fluctuations of the amount of the magnetic flux and obtain a higher cogging torque reduction effect.

A ring-shaped powder compact for producing the sintered ring magnet 250 of FIG. 25 is pressed by using a die which is essentially similar to the die 31 of the first embodiment or the die 80 of the second embodiment except for the shape of corrugations formed on a generally cylindrical inner surface of the die. Specifically, the generally cylindrical inner surface of the die of the sixth embodiment is corrugated with hollows and protrusions alternately formed at regular intervals in a circumferential direction. These protrusions are skewed about a central axis of the die with skew angle of the corrugations becoming smaller toward both axial ends of the die. A ring-shaped powder compact pressing process and a ring magnet manufacturing process of the sixth embodiment are essentially the same as discussed with reference to the aforementioned first or second embodiment.

Figure 26:
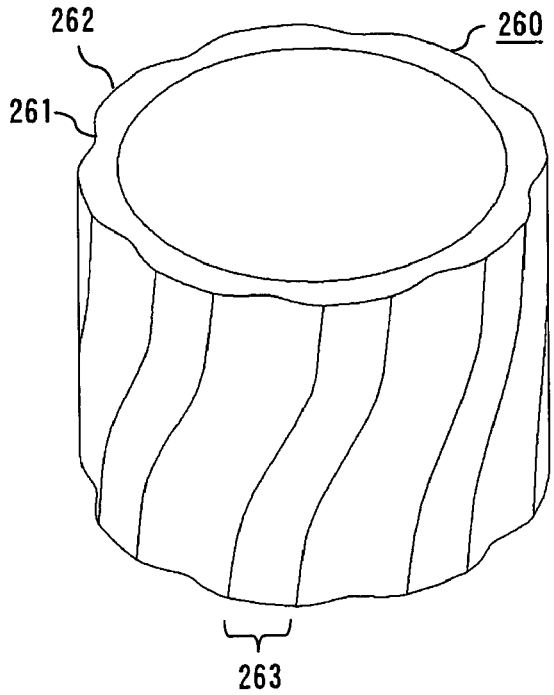
FIG. 26 is a perspective view of a sintered ring magnet produced by a manufacturing apparatus and method in one modified form of the sixth embodiment of the invention.

FIG. 26 is a perspective view of a sintered ring magnet 260 produced by a ring magnet manufacturing apparatus and method in one modified form of the sixth embodiment of the invention. The sintered ring magnet 260 having corrugations formed by alternating hollows 261 and protrusions 262 on a generally cylindrical outer surface as shown in FIG. 26 is an example in which, as viewed along a central axis of the ring magnet 260, outermost surfaces of the ring magnet 260 each form part of a circle (or an arc segment 263 in cross section) of which center lies on the central axis of the ring magnet 260. When incorporated in a motor, the ring magnet 260 thus structured compensates for fluctuations of the amount of magnetic flux and produces a cogging torque reduction effect by virtue of skewed magnetization design. Additionally, the motor incorporating the ring magnet 260 of this modified form of the embodiment can produce an increased output power with reduced cogging torque.

Depending on magnet manufacturing method, magnetic properties of a sintered ring magnet could vary along the axial direction due to variations in magnetic orientation characteristics or impurities contained in the magnet, for instance. Therefore, the sintered ring magnet may be structured such that the skew angle decreases in areas where the amount of generated magnetic flux is small.

A ring-shaped powder compact for producing the sintered ring magnet 260 of FIG. 26 is pressed by using a die which is essentially similar to the die 31 of the first embodiment or the die 80 of the second embodiment except for the shape of corrugations formed on a generally cylindrical inner surface of the die. Specifically, the generally cylindrical inner surface of the die of this modified form of the sixth embodiment is corrugated with hollows and protrusions alternately formed at regular intervals in a circumferential direction. These protrusions are skewed about a central axis of the die with skew angle of the corrugations becoming smaller toward both axial ends of the die. As viewed along an axial direction of the die, an outermost portion of each of the hollows forms part of a circle (or an arc segment in cross section) of which center lies on the central axis of the generally cylindrical inner surface of the die.

Seventh Embodiment

Figure 27:
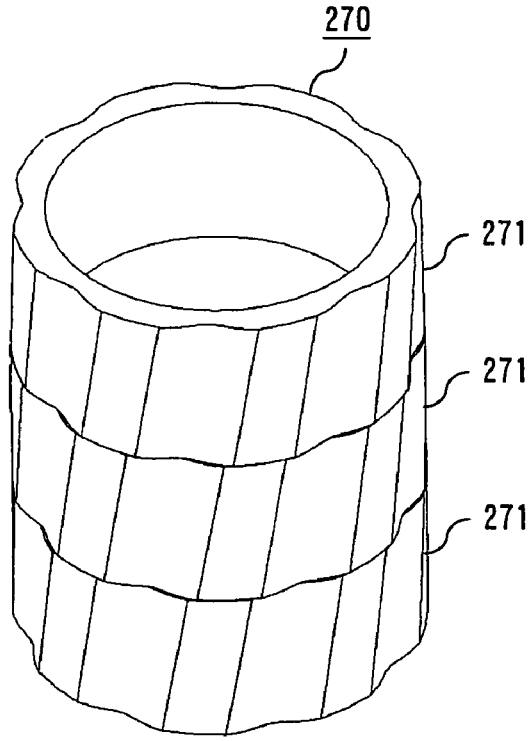
FIG. 27 is a perspective view of a sintered ring magnet produced by a manufacturing apparatus and method according to a seventh embodiment of the invention.

FIG. 27 is a perspective view of a sintered ring magnet 270 produced by a ring magnet manufacturing apparatus and method according to a seventh embodiment of the invention. While the sintered ring magnet 270 of FIG. 27 is produced by stacking a plurality of ring-shaped powder compacts 271, the individual ring-shaped powder compacts 271 of the ring magnet 270 are stacked with a specific layer-to-layer angular displacement so that outer contours of facing end surfaces of the adjacent ring-shaped powder compacts 271 do not match up with one another. According to this embodiment, it is possible to reduce cogging torque by stacking the individual ring-shaped powder compacts 271 with a layer-to-layer angular displacement which is determined such that cogging torque generated by the ring-shaped powder compact 271 in one layer cancels out cogging torque generated by the ring-shaped powder compact 271 in another layer, or such that phases of the cogging torques generated by the individual ring-shaped powder compacts 271 are displaced from one another.

If a sintered ring magnet having eight magnetic poles produced according to this embodiment is used in a motor of which stator has 12 slots, the motor produces cogging torque causing 24 vibrations per rotation, that is, at intervals of 15° (=360°÷24). If the ring-shaped powder compacts 271 are stacked with a layer-to-layer angular displacement of half this 15° interval, or 7.5°, vibrations due to the cogging torque generated by the adjacent ring-shaped powder compacts 271 are canceled out each other, resulting in an overall cogging torque reduction.

Eighth Embodiment

Figure 28:
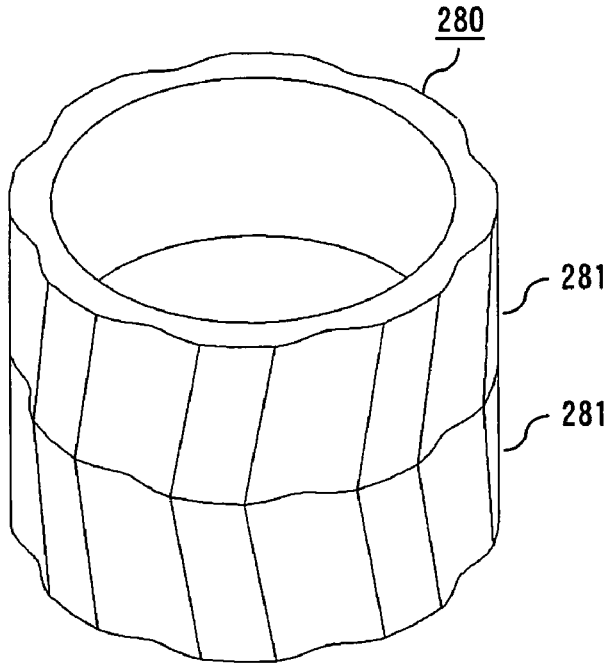
FIG. 28 is a perspective view of a sintered ring magnet produced by a manufacturing apparatus and method according to an eighth embodiment of the invention.

FIG. 28 is a perspective view of a sintered ring magnet 280 produced by a ring magnet manufacturing apparatus and method according to an eighth embodiment of the invention. The ring magnet 280 of FIG. 28 is an example of a sintered ring magnet having an interlayer boundary which is perpendicular to an axial direction of the ring magnet. Specifically, the sintered ring magnet 280 shown in FIG. 28 is formed by stacking and sintering two (upper and lower) ring-shaped powder compacts 281, each having a generally cylindrical outer surface which is corrugated with alternating hollows and protrusions formed at regular intervals in a circumferential direction. In the sintered ring magnet 280 shown in FIG. 28, the hollows and the protrusions formed on the upper and lower ring-shaped powder compacts 281 are skewed in opposite directions on opposite sides of an interlayer boundary as illustrated. This structure of the ring magnet 280 can cancel out, or average, forces exerted on the individual ring-shaped powder compacts along the axial direction and thereby reduce acoustic noise and vibrations when used in a motor.

What is claimed is:

1. An apparatus for manufacturing a ring-shaped powder compact, said apparatus comprising:

a ring-shaped die formed by combining a plurality of arch-shaped members;

a core placed inside a curved inner surface of the die; and pressurizing parts for pressurizing both the die and magnetic powder filled into a cavity formed between the die and the core in an axial direction of the die;

wherein the curved inner surface of the die is corrugated with hollows and protrusions alternately formed at regular intervals in a circumferential direction, the hollows and the protrusions formed on the corrugated curved inner surface of the die being skewed about a central axis thereof, a curved outer surface of each of the pressurizing parts is corrugated with hollows and protrusions which run along the hollows and the protrusions formed on the corrugated curved inner surface of the die, and wherein at least one of the pressurizing parts is moved along the axial direction to compress the magnetic powder during a magnetic powder compression process, during which the pressurizing parts are rotated about the central axis by as much as a skew angle of the hollows and the protrusions formed on the curved inner surface of the die in synchronism with movement of said at least one of the pressurizing parts along the axial direction.

2. An apparatus for manufacturing a ring-shaped powder compact according to claim 1 further comprising mechanisms for moving the arch-shaped members in radial directions of the ring-shaped die.

3. An apparatus for manufacturing a ring-shaped powder compact according to claim 1, wherein, as viewed in cross section perpendicular to the central axis of the die, outermost portions of the hollows in the corrugated curved inner surface of the die form arc segments constituting part of a circle whose center lies on the central axis of the die.

4. An apparatus for manufacturing a ring-shaped powder compact according to claim 1, wherein the hollows and the protrusions formed on the curved inner surface of the die are skewed by a smaller skew angle near both axial ends of the die than in a mid-length region thereof.

5. A method of manufacturing a sintered ring magnet performed by using an apparatus for manufacturing a ring-shaped powder compact, said apparatus including a ring-shaped die having magnetic property formed by combining a plurality of arch-shaped members, a core placed inside a curved inner surface of the die, and pressurizing parts for pressurizing both the die and magnetic powder filled into a cavity formed between the die and the core in an axial direction of the die, wherein the curved inner surface of the die is corrugated with hollows and protrusions alternately formed at regular intervals in a circumferential direction, the hollows and the protrusions formed on the corrugated curved inner surface of the die being skewed about a central axis thereof, and a curved outer surface of each of the pressurizing carts is corrugated with hollows and protrusions which run along the hollows and the protrusions formed on the corrugated curved inner surface of the die, said method comprising the steps of:

filling the magnetic powder into the cavity and applying a radially orienting magnetic field to the magnetic powder;

producing the ring-shaped powder compact by pressurizing the magnetic powder in the cavity in the axial direction by moving at least one of the pressurizing parts along the axial direction to compress the magnetic powder while rotating the pressurizing parts about the central axis by as much as a skew angle of the hollows and the protrusions formed on the curved inner surface of the die in synchronism with movement of said at least one of the pressurizing parts along the axial direction; and sintering the ring-shaped powder compact.

6. A method of manufacturing a sintered ring magnet according to claim 5, wherein the ring-shaped powder compact is so magnetized as to possess the same number of magnetic poles as the number of the protrusions formed at regular intervals in the circumferential direction on the corrugated curved inner surface of the die so that boundaries of the magnetic poles are located in hollows formed on a corrugated curved outer surface of the sintered ring magnet.

7. An apparatus for manufacturing a ring-shaped powder compact according to claim 1, wherein the die including the arch-shaped members is made of ferromagnetic material.

* * * * *